US011740026B2

(12) United States Patent
Yamada et al.

(10) Patent No.: US 11,740,026 B2
(45) Date of Patent: Aug. 29, 2023

(54) HEAT EXCHANGER AND HEAT PUMP APPARATUS

(71) Applicant: DAIKIN INDUSTRIES, LTD., Osaka (JP)

(72) Inventors: Kouju Yamada, Osaka (JP); Tomoki Hirokawa, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 17/562,363

(22) Filed: Dec. 27, 2021

(65) Prior Publication Data

US 2022/0120504 A1 Apr. 21, 2022

Related U.S. Application Data

(63) Continuation of application No. PCT/JP2020/024602, filed on Jun. 23, 2020.

(30) Foreign Application Priority Data

Jun. 28, 2019 (JP) ..... 2019-122165

(51) Int. Cl.
*F28D 7/16* (2006.01)
*F28F 9/02* (2006.01)

(52) U.S. Cl.
CPC . *F28D 7/16* (2013.01); *F28F 9/02* (2013.01)

(58) Field of Classification Search
CPC ... F28D 7/16; F28F 9/02; F28F 9/0224; F28F 9/0221

(Continued)

(56) References Cited

U.S. PATENT DOCUMENTS 5,241,839 A 9/1993 Hughes
5,242,016 A 9/1993 Voss et al.

(Continued)

FOREIGN PATENT DOCUMENTS

EP 2998680 A1 3/2016
EP 3136039 A1 3/2017

(Continued)

OTHER PUBLICATIONS

International Preliminary Report on Patentability issued in corresponding International Application No. PCT/JP2020/024602, dated Dec. 28, 2021 (6 pages).

(Continued)

*Primary Examiner* — Tho V Duong
*Assistant Examiner* — Raheena R Malik
(74) *Attorney, Agent, or Firm* — Osha Bergman Watanabe & Burton LLP

(57) ABSTRACT

A heat exchanger is connected to a first pipe through which a refrigerant flows. The heat exchanger includes: heat transfer tubes; and a header connected to the heat transfer tubes. The header includes: a first plate-shaped portion connected to the first pipe; a second plate-shaped portion connected to the heat transfer tubes; a third plate-shaped portion disposed between the first plate-shaped portion and the second plate-shaped portion; and a fourth plate-shaped portion that is disposed between the third plate-shaped portion and the second plate-shaped portion and that has communication openings for the heat transfer tubes. The first plate-shaped portion, the third plate-shaped portion, the fourth plate-shaped portion, and the second plate-shaped portion are stacked and overlap in a stacking direction. The third plate-shaped portion has a refrigerant flow path formation opening including: a first region through which the refrig- (Continued)

erant flows in a first direction perpendicular to the stacking direction.

18 Claims, 23 Drawing Sheets

(58) Field of Classification Search
USPC ..... 165/175
See application file for complete search history.

(56) References Cited

U.S. PATENT DOCUMENTS

| | | | | |
|---|---|---|---|---|
| 7,044,208 | B2 * | 5/2006 | Kawakubo | F28D 1/05375 165/173 |
| 7,152,669 | B2 * | 12/2006 | Kroetsch | F28F 9/0265 165/149 |
| 7,571,761 | B2 * | 8/2009 | Katoh | F28F 9/0221 165/174 |
| 7,819,177 | B2 * | 10/2010 | Beamer | F28F 9/0246 165/174 |
| 9,103,598 | B2 * | 8/2015 | Bellenfant | F28D 1/0408 |
| 10,281,223 | B2 * | 5/2019 | Hofmann | F28F 9/0278 |
| 2003/0188857 | A1 * | 10/2003 | Kawakubo | F28F 9/0243 165/174 |
| 2005/0284621 | A1 | 12/2005 | Katoh et al. | |
| 2009/0229800 | A1 * | 9/2009 | Bhatti | F28D 1/0426 165/165 |
| 2013/0175013 | A1 * | 7/2013 | Yoshioka | F28F 1/022 165/165 |
| 2016/0076823 | A1 | 3/2016 | Okazaki et al. | |
| 2016/0116231 | A1 | 4/2016 | Higashiiue et al. | |
| 2016/0195335 | A1 * | 7/2016 | Nishiyama | F28D 1/05366 165/174 |
| 2016/0223265 | A1 | 8/2016 | Jindou et al. | |
| 2017/0328652 | A1 | 11/2017 | Matsui et al. | |
| 2018/0259269 | A1 | 9/2018 | Tsubota et al. | |
| 2019/0033018 | A1 | 1/2019 | Higashiiue et al. | |
| 2019/0093965 | A1 | 3/2019 | Higashiiue et al. | |
| 2019/0170456 | A1 * | 6/2019 | Matsui | F25B 41/00 |
| 2022/0042745 | A1 * | 2/2022 | Hirokawa | B23K 1/0012 |
| 2022/0099374 | A1 * | 3/2022 | Hirokawa | F28F 1/32 |
| 2022/0120504 | A1 * | 4/2022 | Yamada | F28F 9/02 |
| 2022/0155016 | A1 * | 5/2022 | Yamada | F28F 9/0221 |
| 2022/0155017 | A1 * | 5/2022 | Andou | F25B 13/00 |

FOREIGN PATENT DOCUMENTS

| | | | |
|---|---|---|---|
| EP | 3499169 | A1 | 6/2019 |
| FR | 2793016 | A1 | 11/2000 |
| JP | H06-011291 | A | 1/1994 |
| JP | 2006-010262 | A | 1/2006 |
| JP | 2007-531861 | A | 11/2007 |
| JP | 2015-078833 | A | 4/2015 |
| WO | 2014/184914 | A1 | 11/2014 |
| WO | 2015/162678 | A1 | 10/2015 |
| WO | 2016/071946 | A1 | 5/2016 |
| WO | 2017/051728 | A1 | 3/2017 |
| WO | 2017/175346 | A1 | 10/2017 |
| WO | 2017/203566 | A1 | 11/2017 |
| WO | 2019/058514 | A1 | 3/2019 |
| WO | 2019/073610 | A1 | 4/2019 |
| WO | 2019/087235 | A1 | 5/2019 |

OTHER PUBLICATIONS

International Search Report issued in corresponding International Application No. PCT/JP2020/024602 dated Aug. 18, 2020 (7 pages).
Decision to Grant a Patent issued in Japanese Patent Application No. 2019-122165 dated Dec. 8, 2020 (5 pages).
Notice of Reasons for Refusal issued in Japanese Patent Application No. 2019-122165 dated Aug. 18, 2020 (12 pages).
Extended European Search Report issued in corresponding European Application No. 20831453.4 dated Jun. 15, 2023 (7 pages).

* cited by examiner

HEAT EXCHANGER AND HEAT PUMP APPARATUS

CROSS-REFERENCE TO RELATED APPLICATIONS

This is a continuation application of International Patent Application No. PCT/JP2020/024602, filed on Jun. 23, 2020, and claims priority to Japanese Patent Application No. 2019-122165, filed on Jun. 28, 2019. The content of these priority applications are incorporated herein by reference.

TECHNICAL FIELD

The present disclosure relates to a heat exchanger and a heat pump apparatus.

BACKGROUND

In some air conditioning apparatuses, a heat exchanger includes a header and a plurality of heat transfer tubes connected to the header.

For example, Patent Literature 1 (WO 2017/051728 A1) discloses a header including a plate-shaped member.

PATENT LITERATURE

Patent Literature 1: WO 2017/051728 A1

SUMMARY

One or more embodiments provide a heat exchanger connected to a first pipe through which a refrigerant flows. The heat exchanger according to one or more embodiments includes a plurality of heat transfer tubes and a header. The header is connected to the heat transfer tubes. The header includes a first plate-shaped portion, a second plate-shaped portion, a third plate-shaped portion, and a fourth plate-shaped portion. The first plate-shaped portion is connected to the first pipe. The second plate-shaped portion is connected to the heat transfer tubes. The third plate-shaped portion is located between the first plate-shaped portion and the second plate-shaped portion. The fourth plate-shaped portion is located between the third plate-shaped portion and the second plate-shaped portion. The fourth plate-shaped portion has a plurality of communication openings for the heat transfer tubes. The first plate-shaped portion, the third plate-shaped portion, the fourth plate-shaped portion, and the second plate-shaped portion are stacked each other so as to overlap each other in a stacking direction. The third plate-shaped portion has a refrigerant flow path formation opening. The refrigerant flow path formation opening includes at least a first region and a second region. In the first region, the refrigerant flows in a first direction perpendicular to the stacking direction. In the second region, the refrigerant flows in a second direction perpendicular to the stacking direction and different from the first direction. The first pipe communicates with the heat transfer tubes via the refrigerant flow path formation opening in the third plate-shaped portion and the communication openings in the fourth plate-shaped portion. The third plate-shaped portion and the fourth plate-shaped portion are stacked in contact with each other. The communication openings and the one first region overlap each other as seen in the stacking direction.

DETAILED DESCRIPTION

A description will be given of an air conditioning apparatus including a heat exchanger to which the present disclosure is applied in accordance with one or more embodiments.

(1) Configuration of Air Conditioning Apparatus

A description will be given of an air conditioning apparatus 1 with reference to the drawings.

Figure 1:
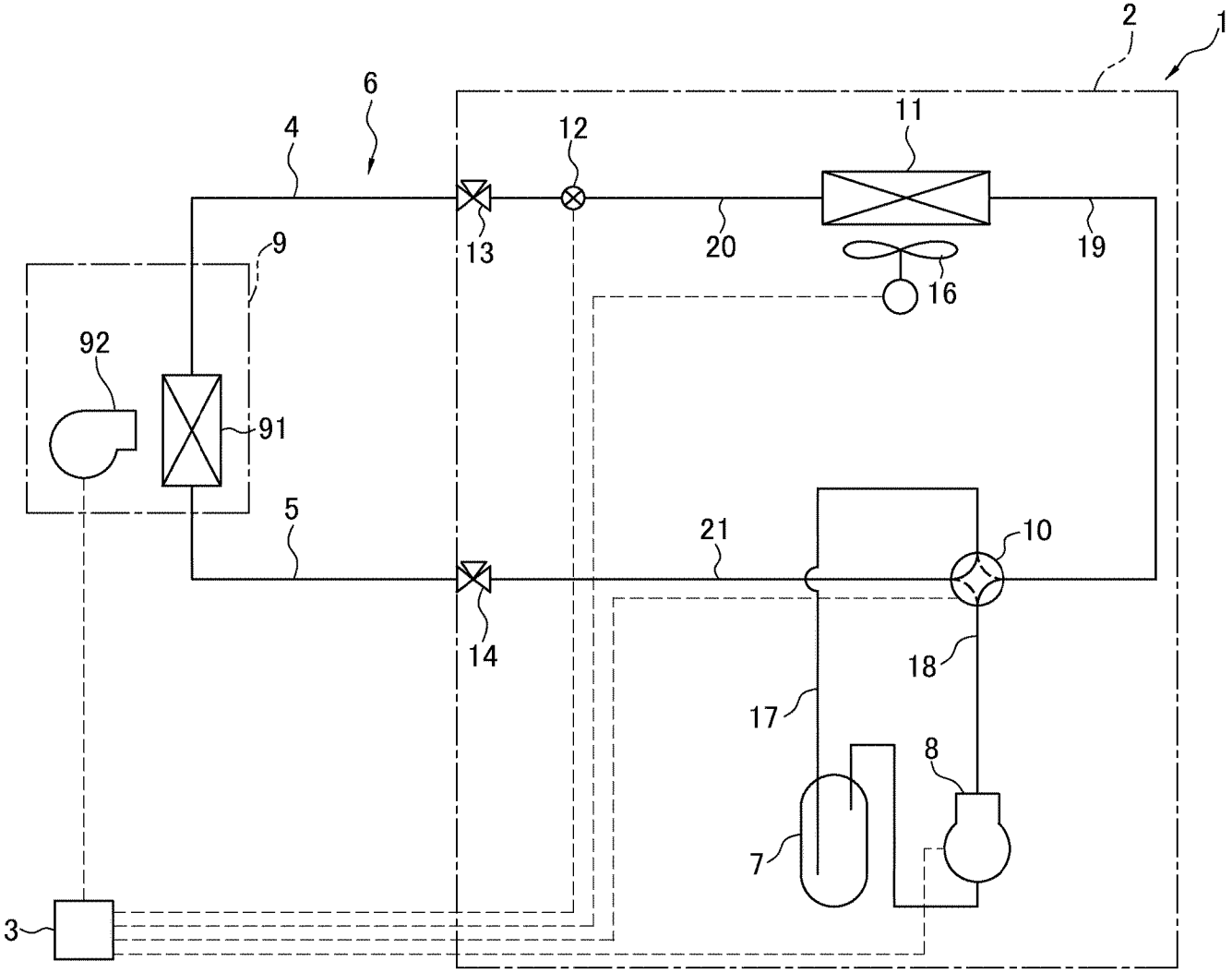
FIG. 1 is a schematic configuration diagram of an air conditioning apparatus according to one or more embodiments.

FIG. 1 is a schematic configuration diagram of the air conditioning apparatus 1 including an outdoor heat exchanger 11 corresponding to a heat exchanger according to one or more embodiments of the present disclosure.

The air conditioning apparatus 1 (which is an example of a heat pump apparatus) is configured to perform a vapor compression refrigeration cycle, thereby cooling and heating an air conditioning target space. Examples of the air conditioning target space may include, but not limited to, spaces in buildings such as an office building, a commercial facility, and a residence. It should be noted that the air conditioning apparatus is merely an example of a refrigerant cycle apparatus. The heat exchanger according to the present disclosure may be used for other refrigerant cycle apparatuses such as a refrigerator, a freezer, a water heater, and an underfloor heating apparatus.

As illustrated in FIG. 1, the air conditioning apparatus 1 mainly includes an outdoor unit 2, an indoor unit 9, a liquid-refrigerant connection pipe 4, a gas-refrigerant connection pipe 5, and a control unit 3 configured to control constituent elements of the outdoor unit 2 and constituent elements of the indoor unit 9. The liquid-refrigerant connection pipe 4 and the gas-refrigerant connection pipe 5 connect the outdoor unit 2 to the indoor unit 9. In the air conditioning apparatus 1, the outdoor unit 2 and the indoor unit 9 are connected via the liquid-refrigerant connection pipe 4 and the gas-refrigerant connection pipe 5 to constitute a refrigerant circuit 6.

The air conditioning apparatus 1 illustrated in FIG. 1 includes one indoor unit 9. The air conditioning apparatus 1 may include a plurality of indoor units 9 connected in parallel to the outdoor unit 2 via the liquid-refrigerant connection pipe 4 and the gas-refrigerant connection pipe 5. The air conditioning apparatus 1 may alternatively include a plurality of outdoor units 2. The air conditioning apparatus 1 may alternatively include an outdoor unit 2 and an indoor unit 9 that are integrated with each other.

(1-1) Outdoor Unit

The outdoor unit 2 is installed outside the air conditioning target space. For example, the outdoor unit 2 is installed on the rooftop of a building or near a wall surface of a building.

The outdoor unit 2 mainly includes an accumulator 7, a compressor 8, a four-way switching valve 10, the outdoor heat exchanger 11, an expansion mechanism 12, a liquid-side shutoff valve 13, a gas-side shutoff valve 14, and an outdoor fan 16 (see FIG. 1).

The outdoor unit 2 mainly includes, as refrigerant pipes for connecting various constituent elements of the refrigerant circuit 6, a suction pipe 17, a discharge pipe 18, a first gas-refrigerant pipe 19, a liquid-refrigerant pipe 20, and a second gas-refrigerant pipe 21 (see FIG. 1). The suction pipe 17 connects the four-way switching valve 10 and a suction side of the compressor 8. The suction pipe 17 is provided with the accumulator 7. The discharge pipe 18 connects a discharge side of the compressor 8 and the four-way switching valve 10. The first gas-refrigerant pipe 19 connects the four-way switching valve 10 and a gas side of the outdoor heat exchanger 11. The liquid-refrigerant pipe 20 connects a liquid side of the outdoor heat exchanger 11 and the liquid-side shutoff valve 13. The liquid-refrigerant pipe 20 is provided with the expansion mechanism 12. The second gas-refrigerant pipe 21 connects the four-way switching valve 10 and the gas-side shutoff valve 14.

The compressor 8 is configured to suck in a low-pressure refrigerant in the refrigeration cycle, through the suction pipe 17, compress the refrigerant in a compression mechanism (not illustrated), and discharge the compressed refrigerant to the discharge pipe 18.

The four-way switching valve 10 is configured to switch a refrigerant flowing direction, thereby changing a state of the refrigerant circuit 6 between a cooling operation state and a heating operation state. When the refrigerant circuit 6 is in the cooling operation state, the outdoor heat exchanger 11 functions as a radiator (a condenser) for the refrigerant, and an indoor heat exchanger 91 functions as an evaporator for the refrigerant. When the refrigerant circuit 6 is in the heating operation state, the outdoor heat exchanger 11 functions as an evaporator for the refrigerant, and the indoor heat exchanger 91 functions as a condenser for the refrigerant. When the four-way switching valve 10 switches the state of the refrigerant circuit 6 to the cooling operation state, the four-way switching valve 10 causes the suction pipe 17 to communicate with the second gas-refrigerant pipe 21, and causes the discharge pipe 18 to communicate with the first gas-refrigerant pipe 19 (see a solid line in the four-way switching valve 10 illustrated in FIG. 1). When the four-way switching valve 10 switches the state of the refrigerant circuit 6 to the heating operation state, the four-way switching valve 10 causes the suction pipe 17 to communicate with the first gas-refrigerant pipe 19, and causes the discharge pipe 18 to communicate with the second gas-refrigerant pipe 21 (see a broken line in the four-way switching valve 10 illustrated in FIG. 1).

The outdoor heat exchanger 11 (which is an example of a heat exchanger) is configured to cause the refrigerant flowing therethrough to exchange heat with air (heat source air) in the place where the outdoor unit 2 is installed. A specific description on the outdoor heat exchanger 11 will be given later.

The expansion mechanism 12 is disposed between the outdoor heat exchanger 11 and the indoor heat exchanger 91 in the refrigerant circuit 6. In one or more embodiments, the expansion mechanism 12 is disposed on the liquid-refrigerant pipe 20 between the outdoor heat exchanger 11 and the liquid-side shutoff valve 13. In the air conditioning apparatus 1, the outdoor unit 2 includes the expansion mechanism 12. Alternatively, the indoor unit 9 (to be described later) may include the expansion mechanism 12. The expansion mechanism 12 is configured to adjust a pressure and a flow rate of the refrigerant flowing through the liquid-refrigerant pipe 20. In one or more embodiments, the expansion mechanism 12 is an opening degree-changeable electronic expansion valve. The expansion mechanism 12 may alternatively be a feeler bulb-type expansion valve or a capillary tube.

The accumulator 7 has a gas-liquid separating function of separating the refrigerant, which flows thereinto, into the gas refrigerant and the liquid refrigerant. The accumulator 7 also has a surplus refrigerant storing function of storing a surplus of the refrigerant in accordance with, for example, a variation in operation load.

The liquid-side shutoff valve 13 is disposed on a joint between the liquid-refrigerant pipe 20 and the liquid-refrigerant connection pipe 4. The gas-side shutoff valve 14 is disposed on a joint between the second gas-refrigerant pipe 21 and the gas-refrigerant connection pipe 5. The liquid-side shutoff valve 13 and the gas-side shutoff valve 14 are open during the operation of the air conditioning apparatus 1.

The outdoor fan 16 (which is an example of a fan) is configured to take heat source air from the outside in a casing (not illustrated) of the outdoor unit 2, supply the heat source air to the outdoor heat exchanger 11, and discharge the air subjected to heat exchange with the refrigerant in the outdoor heat exchanger 11, from the casing of the outdoor unit 2. The outdoor fan 16 is, for example, a propeller fan.

(1-2) Indoor Unit

The indoor unit 9 is installed in the air conditioning target space. For example, the indoor unit 9 is designed to be embedded in a ceiling. The indoor unit 9 may alternatively be designed to be suspended from a ceiling, hung on a wall, or placed on a floor. Alternatively, the indoor unit 9 may be installed outside the air conditioning target space. For example, the indoor unit 9 may be installed in an attic, a machine chamber, a garage, or the like. In this case, an air passage is provided for supplying air subjected to heat exchange with the refrigerant in the indoor heat exchanger 91, from the indoor unit 9 to the air conditioning target space. The air passage is, for example, a duct.

The indoor unit 9 mainly includes the indoor heat exchanger 91 and an indoor fan 92 (see FIG. 1).

The indoor heat exchanger 91 causes the refrigerant flowing therethrough to exchange heat with the air in the air conditioning target space. The indoor heat exchanger 91 may be of any type. For example, the indoor heat exchanger 91 may be a fin-and-tube heat exchanger that includes a plurality of heat transfer tubes and a plurality of fins (not illustrated). The indoor heat exchanger 91 has a first end connected to the liquid-refrigerant connection pipe 4 via a refrigerant pipe. The indoor heat exchanger 91 has a second end connected to the gas-refrigerant connection pipe 5 via a refrigerant pipe.

The indoor fan 92 is configured to suck air in the air conditioning target space into a casing (not illustrated) of the indoor unit 9, supply the air to the indoor heat exchanger 91, and blow out the air subjected to heat exchange with the refrigerant in the indoor heat exchanger 91 toward the air conditioning target space. The indoor fan 92 is, for example, a turbo fan. The indoor fan 92 is not limited to a turbo fan, and a fan of any type may be appropriately selected as the indoor fan 92.

(1-3) Control Unit

The control unit 3 is a functional unit configured to control the operations of the various constituent elements of the air conditioning apparatus 1.

For example, the control unit 3 includes an outdoor control unit (not illustrated) of the outdoor unit 2 and an indoor control unit (not illustrated) of the indoor unit 9 that are connected to communicate with each other via a transmission line (not illustrated). Each of the outdoor control unit and the indoor control unit includes, for example, a microcomputer and a memory storing various programs for controlling the air conditioning apparatus 1, the programs being executable by the microcomputer. For sake of convenience, FIG. 1 depicts the control unit 3 at a position away from the outdoor unit 2 and the indoor unit 9.

The functions of the control unit 3 are not necessarily achieved by the cooperation of the outdoor control unit and the indoor control unit. For example, the functions of the control unit 3 may be achieved by one of the outdoor control unit and the indoor control unit. Alternatively, some of or all the functions of the control unit 3 may be achieved by a control device (not illustrated) different from the outdoor control unit and the indoor control unit.

As illustrated in FIG. 1, the control unit 3 is electrically connected to various constituent elements (including the compressor 8, the four-way switching valve 10, the expansion mechanism 12, the outdoor fan 16, and the indoor fan 92) of the outdoor unit 2 and indoor unit 9. The control unit 3 is also electrically connected to various sensors (not illustrated) in the outdoor unit 2 and indoor unit 9. The control unit 3 is capable of communicating with a remote controller (not illustrated) to be operated by a user of the air conditioning apparatus 1.

The control unit 3 starts or stops an operation of the air conditioning apparatus 1 and controls the operations of the various constituent elements of the air conditioning apparatus 1, based on, for example, measurement signals from the various sensors and commands from the remote controller (not illustrated).

(2) Configuration of Outdoor Heat Exchanger

Next, a description will be given of a configuration of the outdoor heat exchanger 11 with reference to the drawings.

Figure 2:
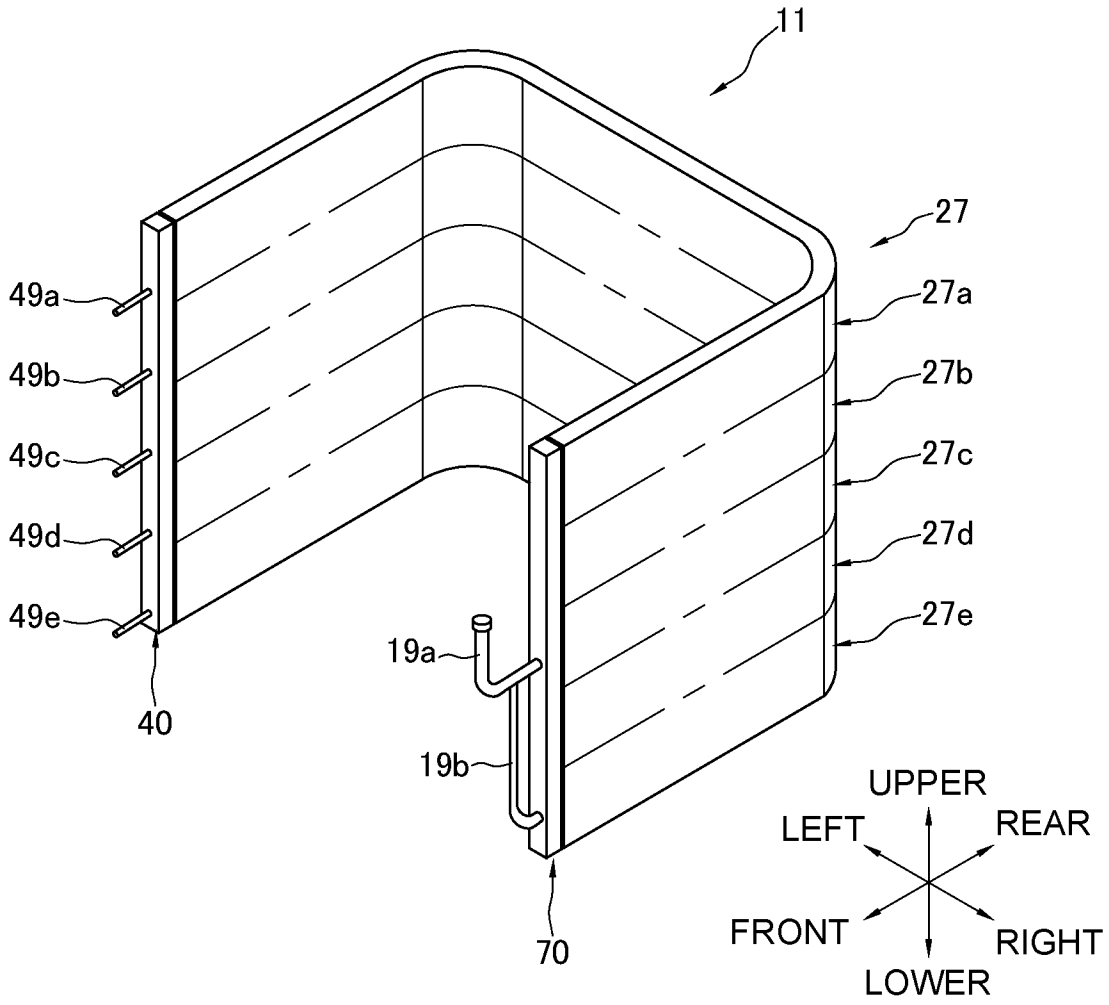
FIG. 2 is a schematic perspective view of an outdoor heat exchanger according to one or more embodiments.
Figure 3:
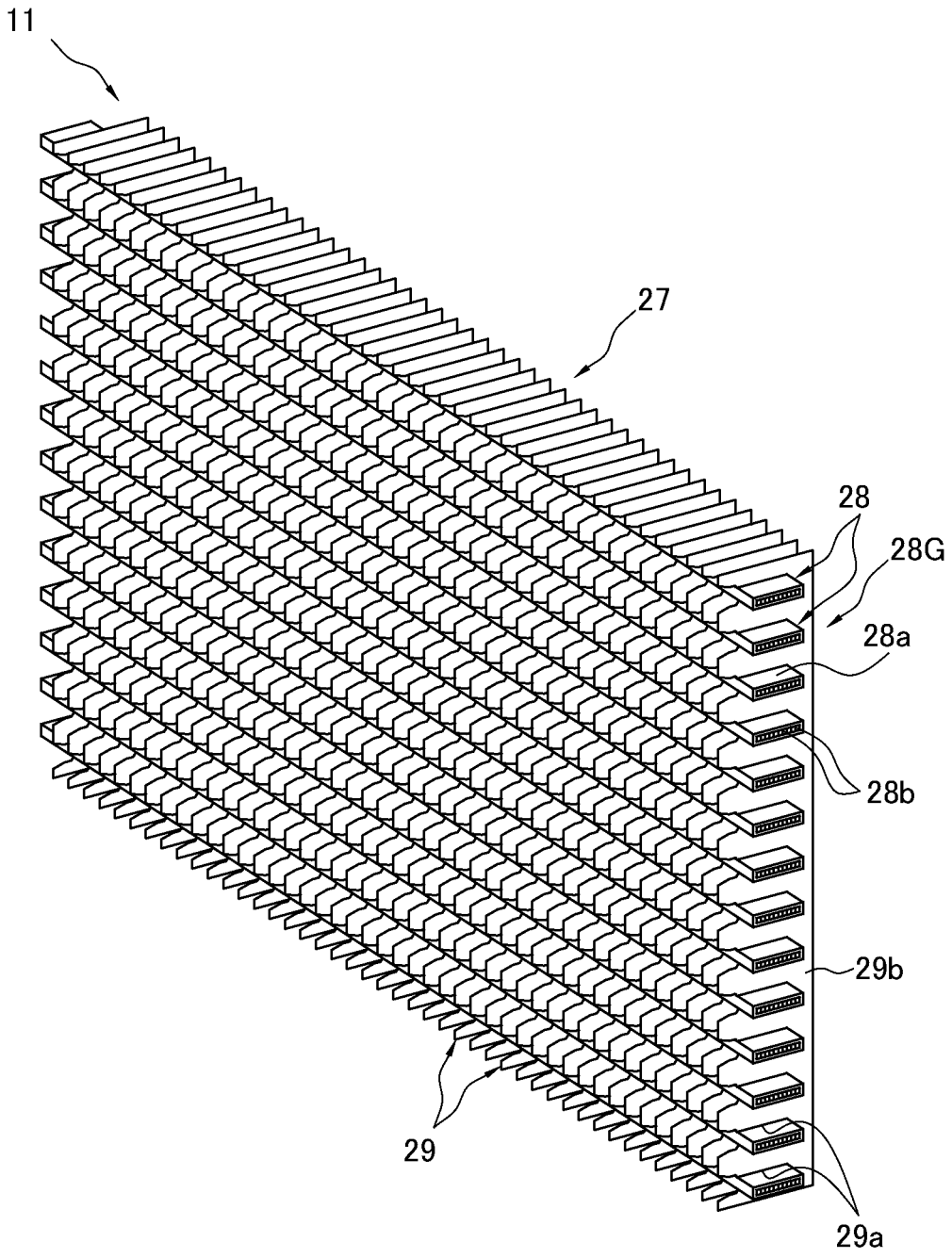
FIG. 3 is a partially enlarged view of a heat exchange part of the outdoor heat exchanger according to one or more embodiments.
Figure 4:
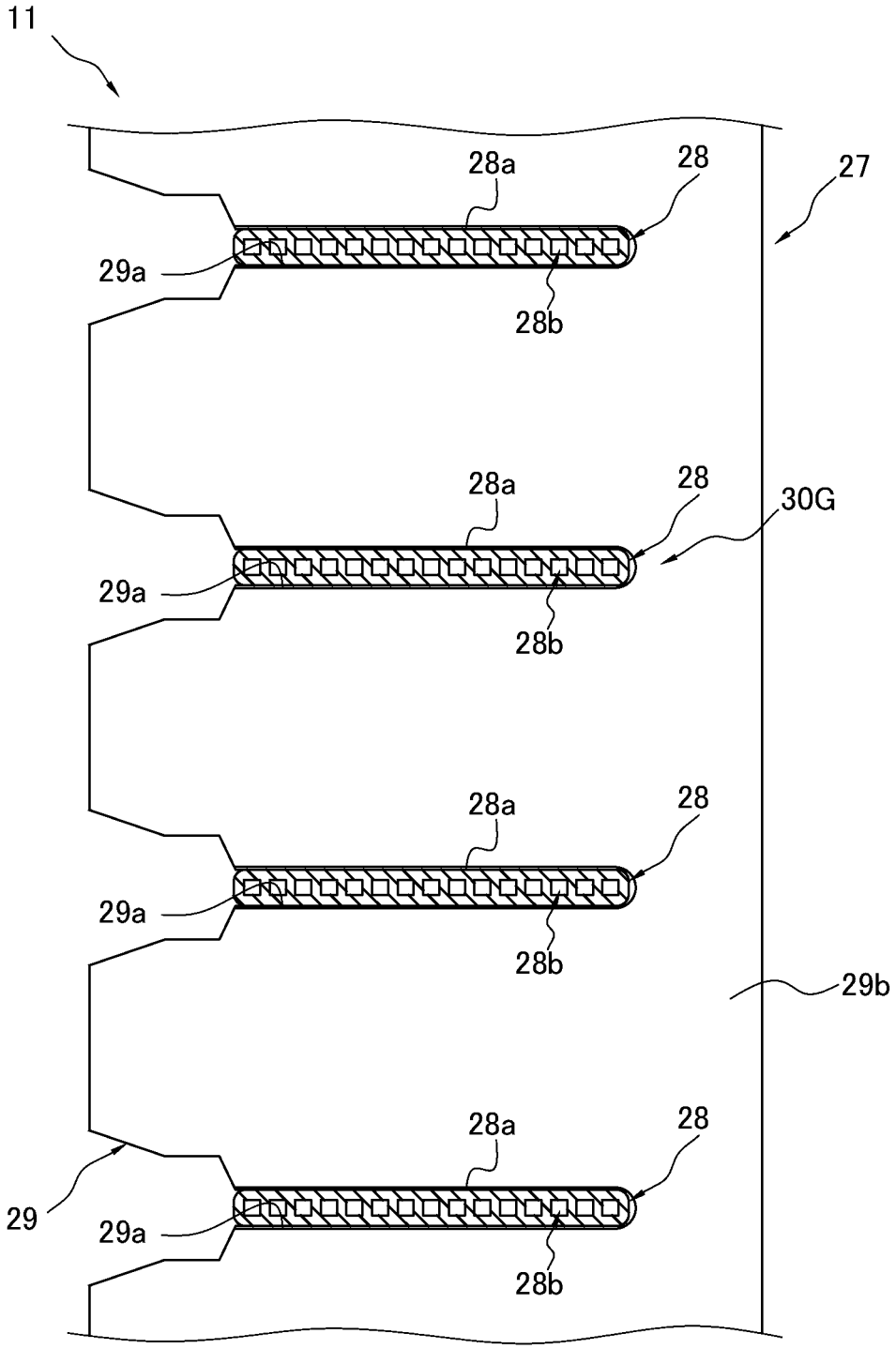
FIG. 4 is a schematic diagram of the heat exchange part in which a heat transfer fin is mounted to a flat tube according to one or more embodiments.
Figure 5:
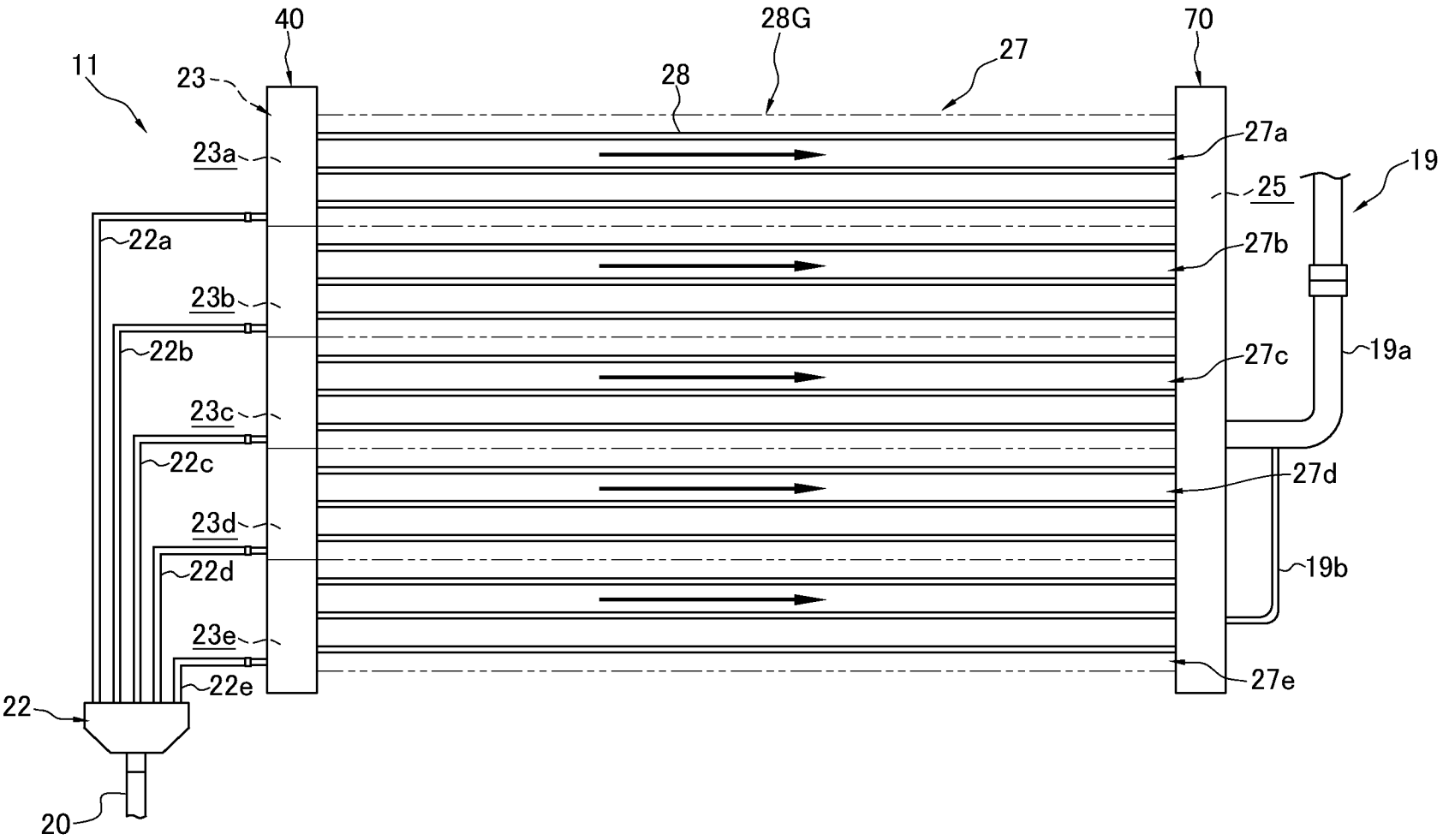
FIG. 5 is a diagram of a flow of a refrigerant in the outdoor heat exchanger functioning as an evaporator for the refrigerant according to one or more embodiments.
Figure 6:
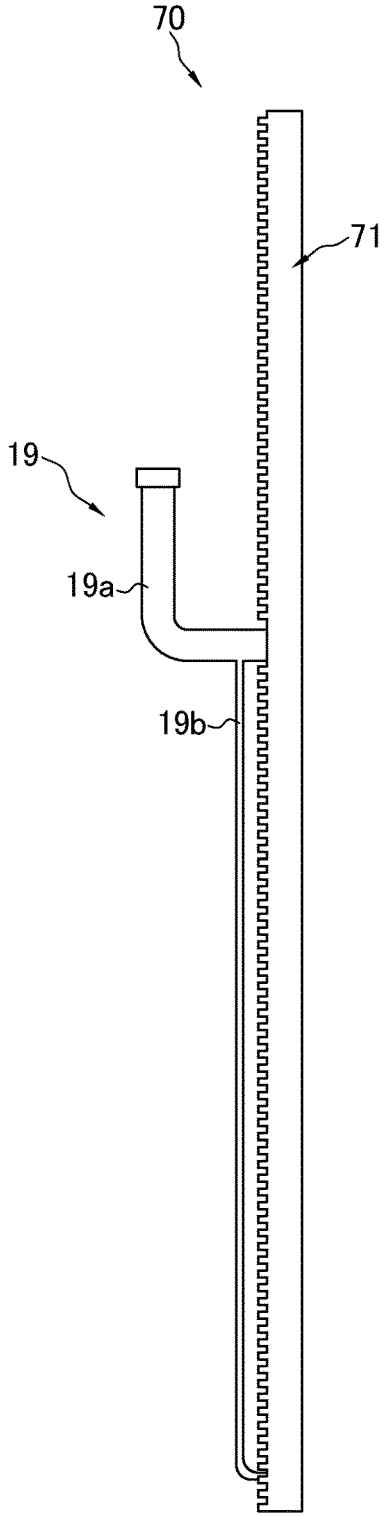
FIG. 6 is an external view of a gas header according to one or more embodiments to which a main gas-refrigerant pipe connection portion is connected as seen from a side view.

FIG. 2 is a schematic perspective view of the outdoor heat exchanger 11. FIG. 3 is a partially enlarged view of a heat exchange part 27 (to be described later) of the outdoor heat exchanger 11. FIG. 4 is a schematic diagram of the heat exchange part 27 in which a fin 29 is mounted to a flat tube 28 (which will be described later). FIG. 5 is a schematic configuration diagram of the outdoor heat exchanger 11. In FIG. 5, arrows depicted in the heat exchange part 27 each indicate a flow of the refrigerant during the heating operation (in which the outdoor heat exchanger 11 functions as an evaporator).

In the following, orientations and positions are sometimes described using the terms "upper (up)", "lower (down)", "left", "right", "front (front face)", and "rear (rear face)". These orientations and positions are defined by the arrows depicted in FIG. 2 unless otherwise specified. It should be noted that the terms representing the orientations and positions are used for sake of convenience of the description and therefore do not specify the orientation and position of the entire outdoor heat exchanger 11 and the orientation and position of each constituent element of the outdoor heat exchanger 11 unless otherwise specified.

The outdoor heat exchanger 11 is configured to cause the refrigerant flowing therethrough to exchange heat with air.

The outdoor heat exchanger 11 mainly includes a shunt 22, a flat tube group 28G that includes the plurality of flat tubes 28 (each of which is an example of a heat transfer tube), the plurality of fins 29, a liquid header 40 (which is an example of a header), and a gas header 70 (see FIGS. 4 and 5). In one or more embodiments, the shunt 22, the flat tubes 28, the fins 29, the liquid header 40, and the gas header 70 are each made of aluminum or an aluminum alloy.

As will be described later, the flat tubes 28 and the fins 29 fixed to the flat tubes 28 constitute the heat exchange part 27 (see FIGS. 2 and 3). The outdoor heat exchanger 11 includes the heat exchange part 27 placed in a line; therefore, the configuration of the outdoor heat exchanger 11 is different from that in which the flat tubes 28 are arranged in the air flowing direction. In the outdoor heat exchanger 11, air flows through an air flow path defined by each flat tube 28 and the corresponding fin 29 in the heat exchange part 27. The outdoor heat exchanger 11 causes the refrigerant flowing through each flat tube 28 to exchange heat with the air flowing through the corresponding air flow path. The heat exchange part 27 is divided into a first heat exchange part 27*a*, a second heat exchange part 27*b*, a third heat exchange part 27*c*, a fourth heat exchange part 27*d*, and a fifth heat exchange part 27*e* arranged in the up-and-down direction (see FIG. 2).

(2-1) Shunt

The shunt 22 is configured to divert the refrigerant. The shunt 22 is also configured to merge the diverted refrigerants into one. The liquid-refrigerant pipe 20 is connected to the shunt 22. The shunt 22 includes a plurality of shunt tubes 22*a* to 22*e*. The shunt 22 has a function of diverting the refrigerant flowing thereinto through the liquid-refrigerant pipe 20 into the shunt tubes 22*a* to 22*e* and leading the diverted refrigerants to spaces defined in the liquid header 40. The shunt 22 also has a function of merging the refrigerants flowing thereinto from the liquid header 40 via the shunt tubes 22*a* to 22*e* into one and leading the refrigerant toward the liquid-refrigerant pipe 20. Specifically, branch liquid-refrigerant connection pipes 49*a* to 49*e* respectively connect the shunt tubes 22*a* to 22*e* to the spaces in the liquid header 40.

(2-2) Flat Tube Group

The flat tube group 28G is an example of a heat transfer tube group. The flat tube group 28G includes the plurality of flat tubes 28 as a plurality of heat transfer tubes. As illustrated in FIG. 3, each of the flat tubes 28 is a flat heat transfer tube having upper and lower flat faces 28*a* each serving as a heat transfer face. As illustrated in FIG. 3, each of the flat tubes 28 includes a plurality of refrigerant passages 28*b* through which the refrigerant flows. Each of the flat tubes 28 is, for example, a flat porous pipe including a plurality of refrigerant passages 28*b* each allowing the refrigerant to flow therethrough and having a small passage sectional area. In one or more embodiments, the refrigerant passages 28*b* are arranged in the air flowing direction. Each of the flat tubes 28 has a maximum width in cross section perpendicular to the refrigerant passages 28*b*. The maximum width may be not less than 70% of an outer diameter of a main gas-refrigerant pipe connection portion 19*a*. The maximum width may alternatively be not less than 85% of the outer diameter of the main gas-refrigerant pipe connection portion 19*a*.

As illustrated in FIG. 5, in the outdoor heat exchanger 11, the flat tubes 28 extend between the liquid header 40 and the gas header 70 in a horizontal direction. Moreover, the flat tubes 28 are arranged up and down in multiple tiers. In one or more embodiments, the flat tubes 28 between the liquid header 40 and the gas header 70 are bent twice, so that the heat exchange part 27 including the flat tubes 28 has a substantially "U" shape as seen in plan view (see FIG. 2). In one or more embodiments, the flat tubes 28 are arranged up and down at certain spacings.

(2-3) Fin

The fins 29 are used for increasing a heat transfer area of the outdoor heat exchanger 11. The fins 29 each have a plate shape extending in a direction in which the flat tubes 28 are arranged in tiers. The outdoor heat exchanger 11 is used in the state in which the flat tubes 28 extending in the horizontal direction are arranged in the up-and-down direction. Therefore, the fins 29 extend in the up-and-down direction with the outdoor heat exchanger 11 installed in the outdoor unit 2.

As illustrated in FIG. 4, each of the fins 29 has a plurality of cutouts 29*a* extending in such a direction that the flat tubes 28 are inserted into the cutouts 29*a*. The cutouts 29*a* extend in the direction in which the fins 29 extend and in a direction orthogonal to a thickness direction of each fin 29. In each fin 29, the cutouts 29*a* extend in the horizontal direction with the outdoor heat exchanger 11 installed in the outdoor unit 2. In each fin 29, the cutouts 29*a* each have a shape that is almost equal to an outer cross-sectional shape of each flat tube 28. In each fin 29, a spacing between adjacent two of the cutouts 29*a* corresponds to the spacing between adjacent two of the flat tubes 28. In the outdoor heat exchanger 11, the fins 29 are arranged in the direction in which the flat tubes 28 extend. In each of the fins 29, the flat tubes 28 are respectively inserted into the cutouts 29*a*, so that an air flow path, through which air flows, is defined between adjacent two of the flat tubes 28.

Each of the fins 29 has a communicating portion 29*b* disposed upstream or downstream of the flat tubes 28 in the air flowing direction. The communicating portions 29*b* extend in the up-and-down direction. In one or more embodiments, the communicating portions 29*b* of the fins 29 are located on the windward side with respect to the flat tubes 28.

(2-4) Gas Header, Liquid Header

The gas header 70 and the liquid header 40 each have a hollow shape.

As illustrated in FIG. 5, the liquid header 40 is connected to a first end of each flat tube 28, and the gas header 70 is connected to a second end of each flat tube 28. The outdoor heat exchanger 11 is disposed in the casing (not illustrated) of the outdoor unit 2 such that a longitudinal direction of each of the liquid header 40 and the gas header 70 is approximately parallel to a vertical direction. In one or more embodiments, as illustrated in FIG. 2, the heat exchange part 27 of the outdoor heat exchanger 11 has the "U" shape as seen in plan view. The liquid header 40 is disposed near the front left corner of the casing (not illustrated) of the outdoor unit 2 (see FIG. 2). The gas header 70 is disposed near the front right corner of the casing (not illustrated) of the outdoor unit 2 (see FIG. 2).

(2-4-1) Gas Header

The gas header 70 has a single space. The gas header 70 has a gas-side internal space 25 that is not divided by partition plates, unlike a liquid-side internal space 23 divided into a plurality of sub-spaces 23*a* to 23*e* arranged up and down in the liquid header 40.

The gas header 70 is connected to a main gas-refrigerant pipe connection portion 19*a* and a branch gas-refrigerant pipe connection portion 19*b* that constitute a gas header 70-side end of the first gas-refrigerant pipe 19 (see FIG. 5). The main gas-refrigerant pipe connection portion 19*a* has an outer diameter that is not limited. For example, the outer diameter of the main gas-refrigerant pipe connection portion 19*a* may be not less than 3 times as large as an outer diameter of the branch gas-refrigerant pipe connection portion 19*b*. The outer diameter of the main gas-refrigerant pipe connection portion 19*a* may alternatively be not less than 5 times as large as the outer diameter of the branch gas-refrigerant pipe connection portion 19*b*.

The main gas-refrigerant pipe connection portion 19*a* has a first end connected to the gas header 70 to communicate with the gas-side internal space 25 at an intermediate position of the gas header 70 in a height direction.

The branch gas-refrigerant pipe connection portion 19*b* has a first end connected to the gas header 70 to communicate with the gas-side internal space 25 at a position near a lower end of the gas header 70 in the height direction. The branch gas-refrigerant pipe connection portion 19*b* has a second end connected to the main gas-refrigerant pipe connection portion 19*a*. The branch gas-refrigerant pipe connection portion 19*b* is smaller in inner diameter than the main gas-refrigerant pipe connection portion 19*a*. The branch gas-refrigerant pipe connection portion 19*b* is connected to the gas header 70 at a position below the main gas-refrigerant pipe connection portion 19*a*. A refrigerating machine oil retained near the lower end of the gas header 70 is thus returned to the compressor 8.

(2-4-2) Liquid Header

The liquid header 40 has the liquid-side internal space 23 divided into the plurality of sub-spaces 23*a* to 23*e* (see FIG. 5).

The sub-spaces 23*a* to 23*e* are arranged in the up-and-down direction. The sub-spaces 23*a* to 23*e* of the liquid-side internal space 23 are in a non-communicating state in the liquid header 40.

The sub-spaces 23*a* to 23*e* are respectively connected to the branch liquid-refrigerant connection pipes 49*a* to 49*e*

(each of which is an example of a first pipe) respectively connected to the shunt tubes 22*a* to 22*e* of the shunt 22. During the cooling operation, when the refrigerant flows into each of the sub-spaces 23*a* to 23*e*, the refrigerants then flow through the branch liquid-refrigerant connection pipes 49*a* to 49*e* and the shunt tubes 22*a* to 22*e*. The refrigerants are then merged into one at the shunt 22. During the heating operation, the shunt 22 diverts the refrigerant. The refrigerants thus diverted flow through the shunt tubes 22*a* to 22*e* and the branch liquid-refrigerant connection pipes 49*a* to 49*e*. The refrigerants then flow into the sub-spaces 23*a* to 23*e*.

(3) Flow of Refrigerant in Outdoor Heat Exchanger

In a case where the air conditioning apparatus 1 carries out the heating operation so that the outdoor heat exchanger 11 functions as an evaporator for the refrigerant, the refrigerant in the gas-liquid two-phase state flows into the shunt 22 through the liquid-refrigerant pipe 20. The diverted refrigerants then flow through the shunt tubes 22*a* to 22*e* and flow into the sub-spaces 23*a* to 23*e* of the liquid-side internal space 23 in the liquid header 40. Specifically, the refrigerant flowing through the shunt tube 22*a* flows into the sub-space 23*a*, the refrigerant flowing through the shunt tube 22*b* flows into the sub-space 23*b*, the refrigerant flowing through the shunt tube 22*c* flows into the sub-space 23*c*, the refrigerant flowing through the shunt tube 22*d* flows into the sub-space 23*d*, and the refrigerant flowing through the shunt tube 22*e* flows into the sub-space 23*e*. When the refrigerants flow into the sub-spaces 23*a* to 23*e* of the liquid-side internal space 23, then the refrigerants flow through the flat tubes 28 respectively connected to the sub-spaces 23*a* to 23*e*. The refrigerants flowing through the flat tubes 28 evaporate by heat exchange with air, so that the gas-phase refrigerants flow into the gas-side internal space 25 in the gas header 70. The gas-phase refrigerants are thus merged into one.

In a case where the air conditioning apparatus 1 carries out the cooling operation or a defrosting operation, the refrigerant flows through the refrigerant circuit 6 in the opposite direction to that during the heating operation. Specifically, the high-temperature gas-phase refrigerant flows into the gas-side internal space 25 in the gas header 70 through the main gas-refrigerant pipe connection portion 19*a* and branch gas-refrigerant pipe connection portion 19*b* of the first gas-refrigerant pipe 19. The refrigerant is diverted in the gas-side internal space 25 in the gas header 70, and the diverted refrigerants then flow into the flat tubes 28. When the refrigerants flow into the flat tubes 28, then the refrigerants flow through the flat tubes 28. The refrigerants then flow into the sub-spaces 23*a* to 23*e* of the liquid-side internal space 23 in the liquid header 40. When the refrigerants flow into the sub-spaces 23*a* to 23*e* of the liquid-side internal space 23, then the refrigerants are merged into one in the shunt 22. The merged refrigerant then flows into the liquid-refrigerant pipe 20.

(4) Details of Liquid Header

Figure 7:
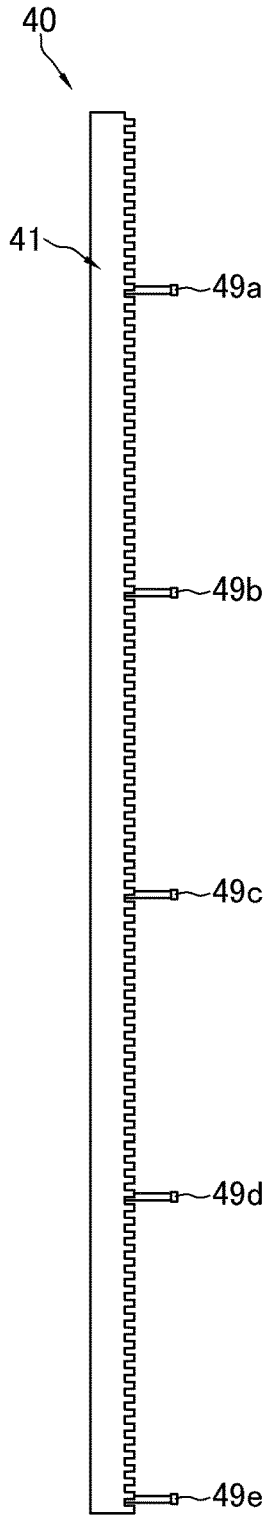
FIG. 7 is an external view of a liquid header according to one or more embodiments to which a branch liquid-refrigerant connection pipe is connected as seen from a side view.
Figure 8:
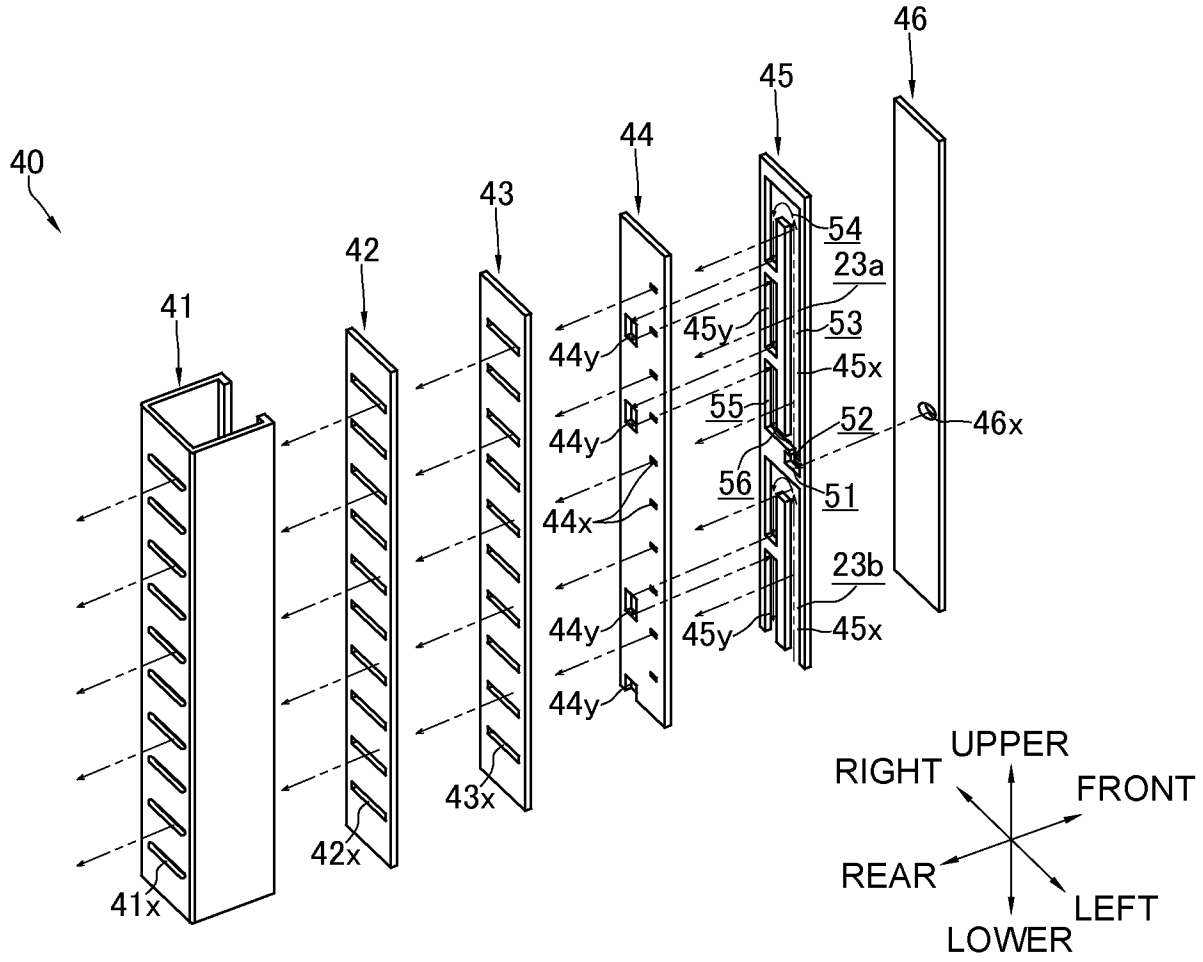
FIG. 8 is an exploded perspective view of the liquid header according to one or more embodiments.
Figure 9:
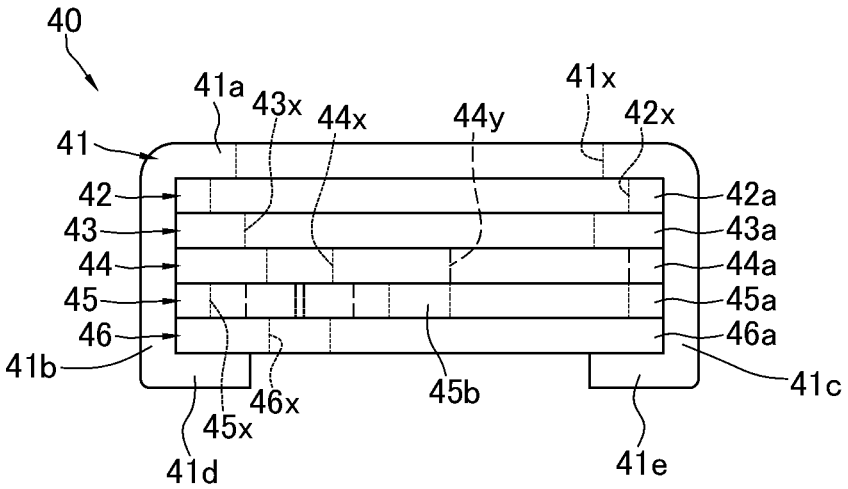
FIG. 9 is a sectional view of the liquid header according to one or more embodiments as seen in plan view.
Figure 9:
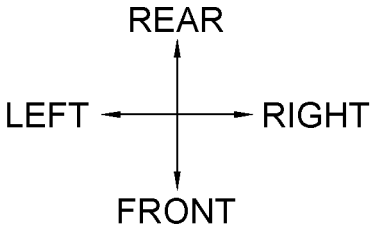
Figure 10:
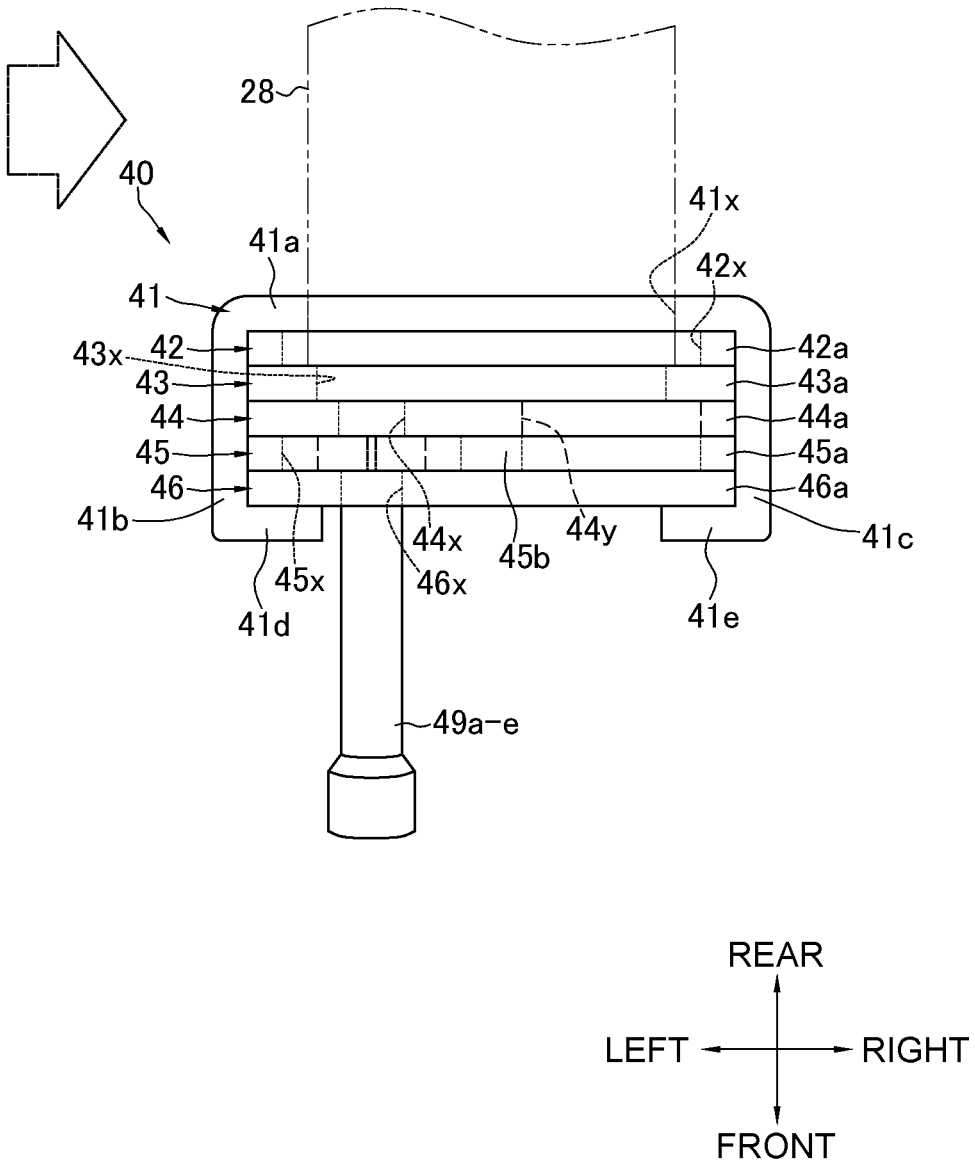
FIG. 10 is a sectional view of the liquid header according to one or more embodiments to which the branch liquid-refrigerant connection pipe and the flat tube are connected as seen in plan view.

FIG. 7 is an external view of the liquid header 40 to which the branch liquid-refrigerant connection pipes 49*a* to 49*e* are connected as seen from a side view. FIG. 8 is an exploded perspective view of the liquid header 40. FIG. 9 is a sectional view of the liquid header 40 as seen in plan view. FIG. 10 is a sectional view of the liquid header 40 to which the branch liquid-refrigerant connection pipes 49*a* to 49*e* and the flat tubes 28 are connected as seen in plan view.

Figure 11:
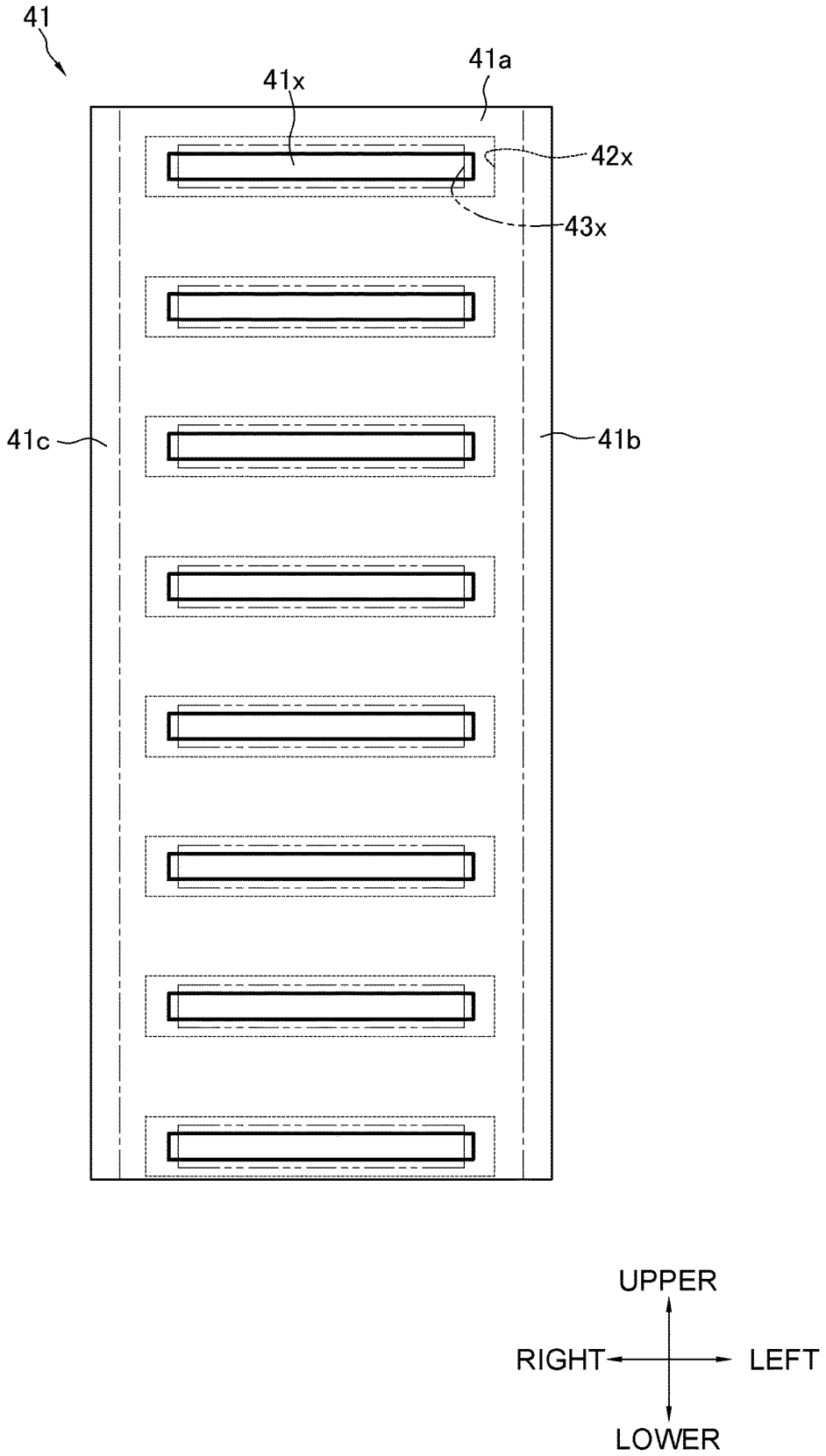
FIG. 11 is a schematic diagram of a rear side of a second liquid-side member according to one or more embodiments.
Figure 12:
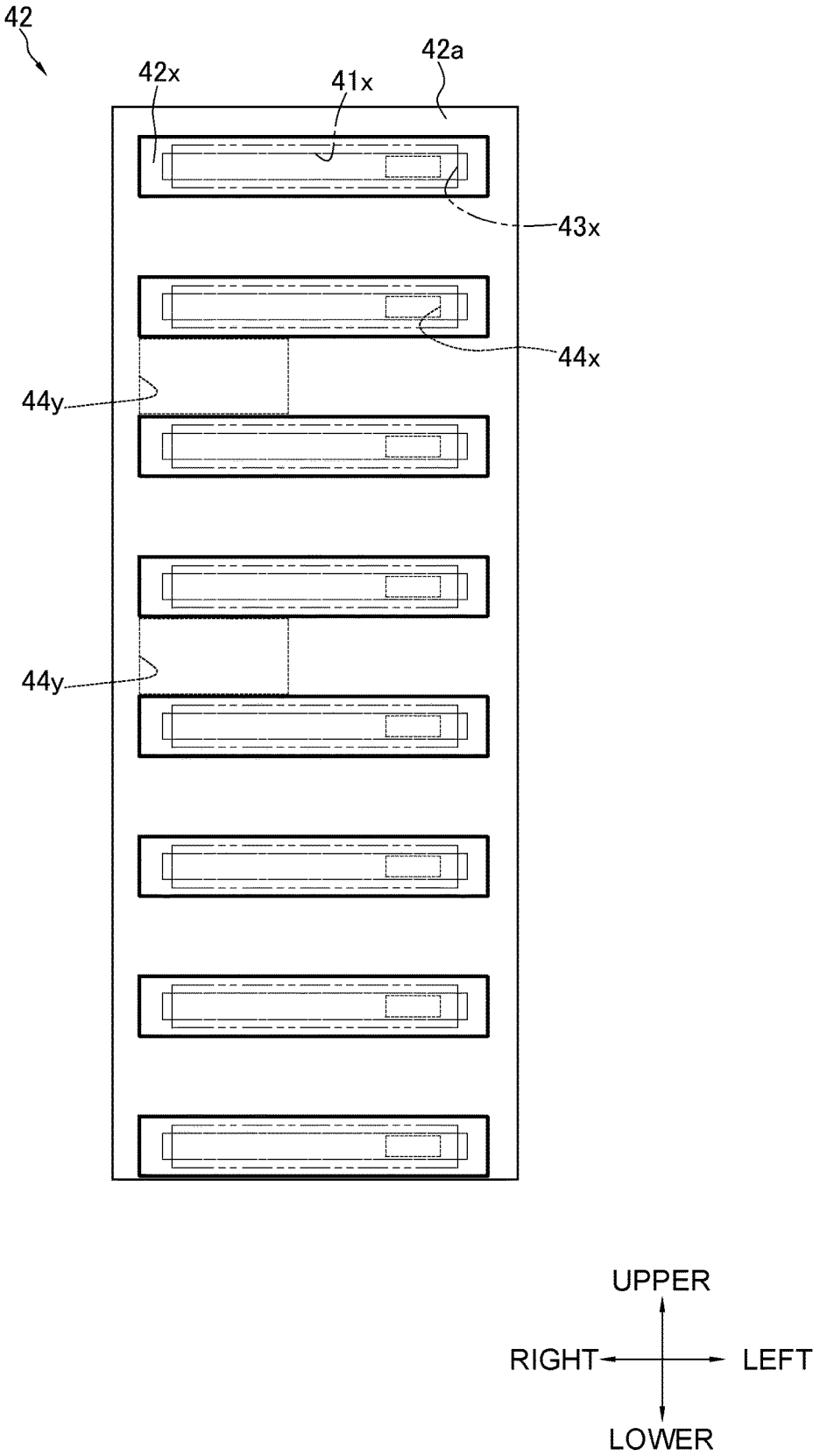
FIG. 12 is a schematic diagram of a rear side of a sixth liquid-side member according to one or more embodiments.
Figure 13:
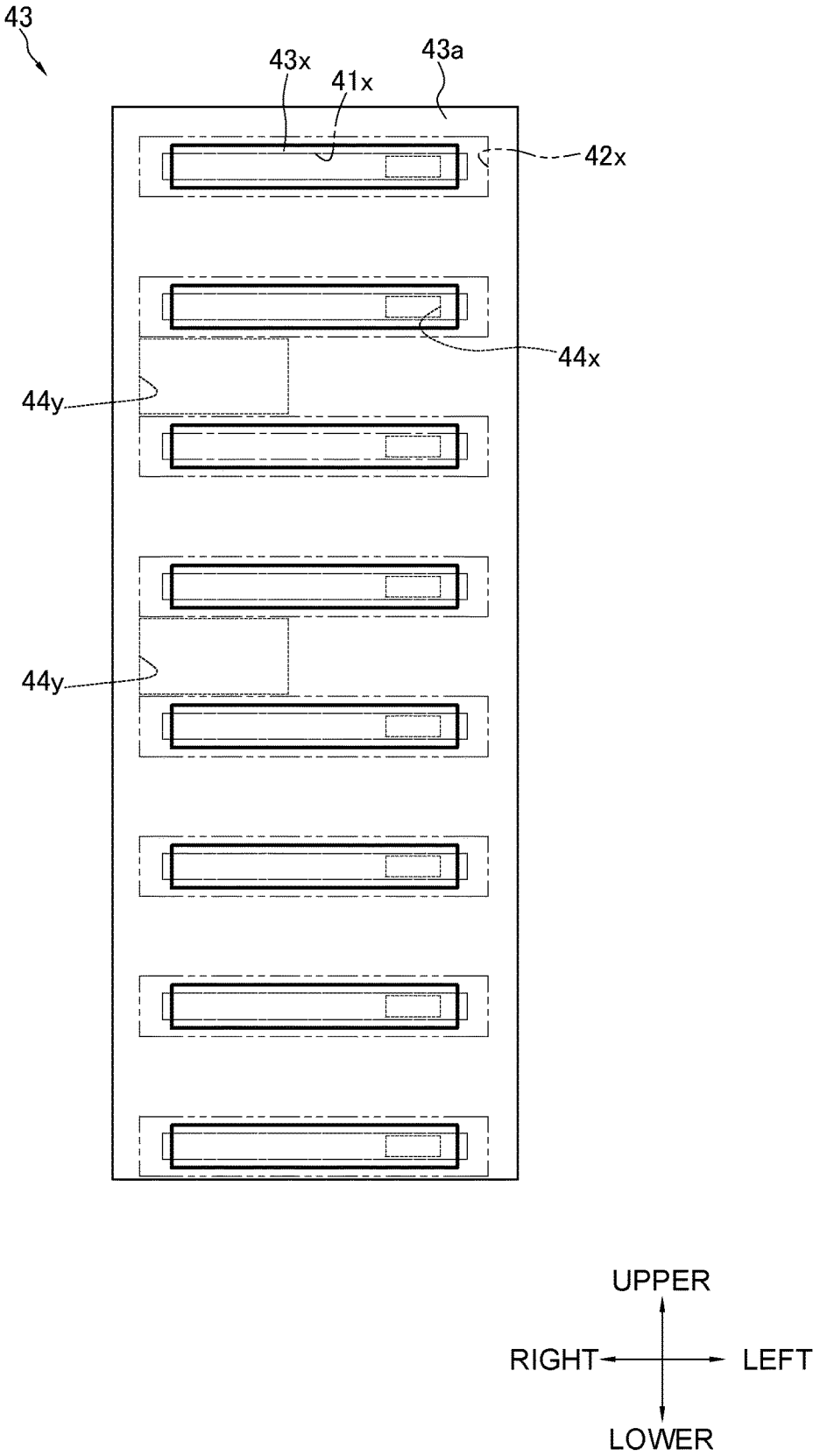
FIG. 13 is a schematic diagram of a rear side of a fifth liquid-side member according to one or more embodiments.
Figure 14:
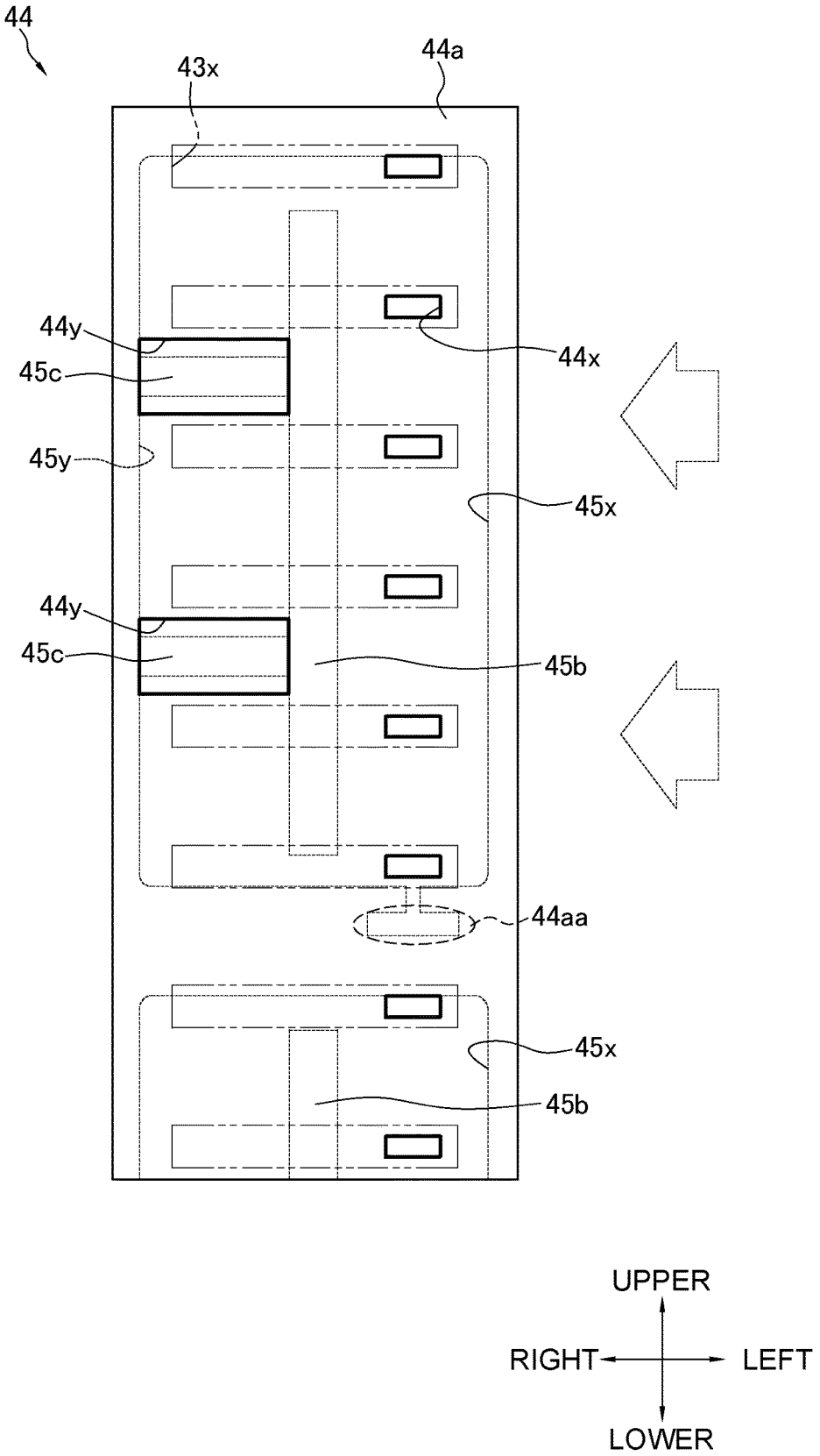
FIG. 14 is a schematic diagram of a rear side of a fourth liquid-side member according to one or more embodiments.
Figure 15:
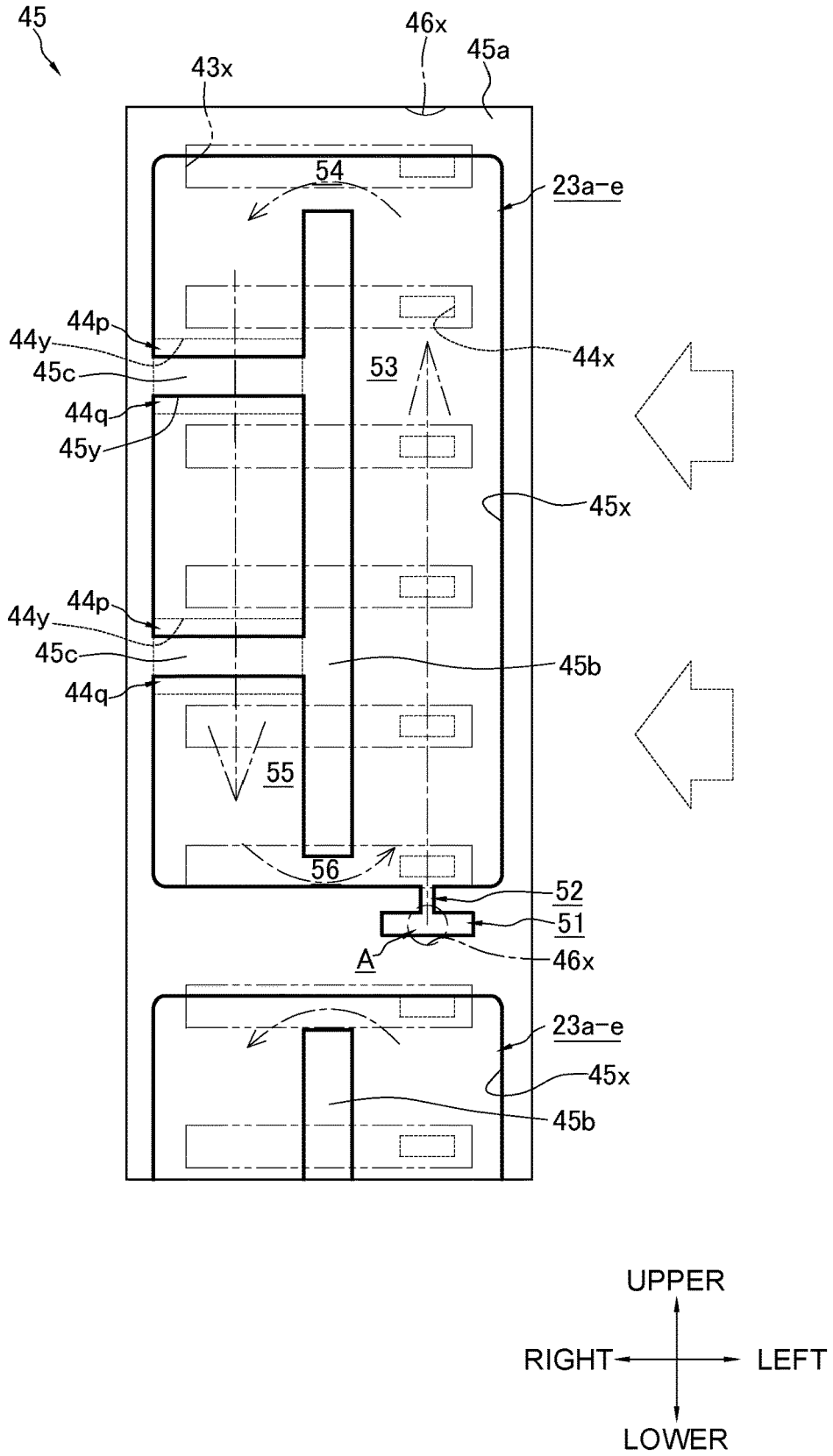
FIG. 15 is a schematic diagram of a rear side of a third liquid-side member according to one or more embodiments.
Figure 16:
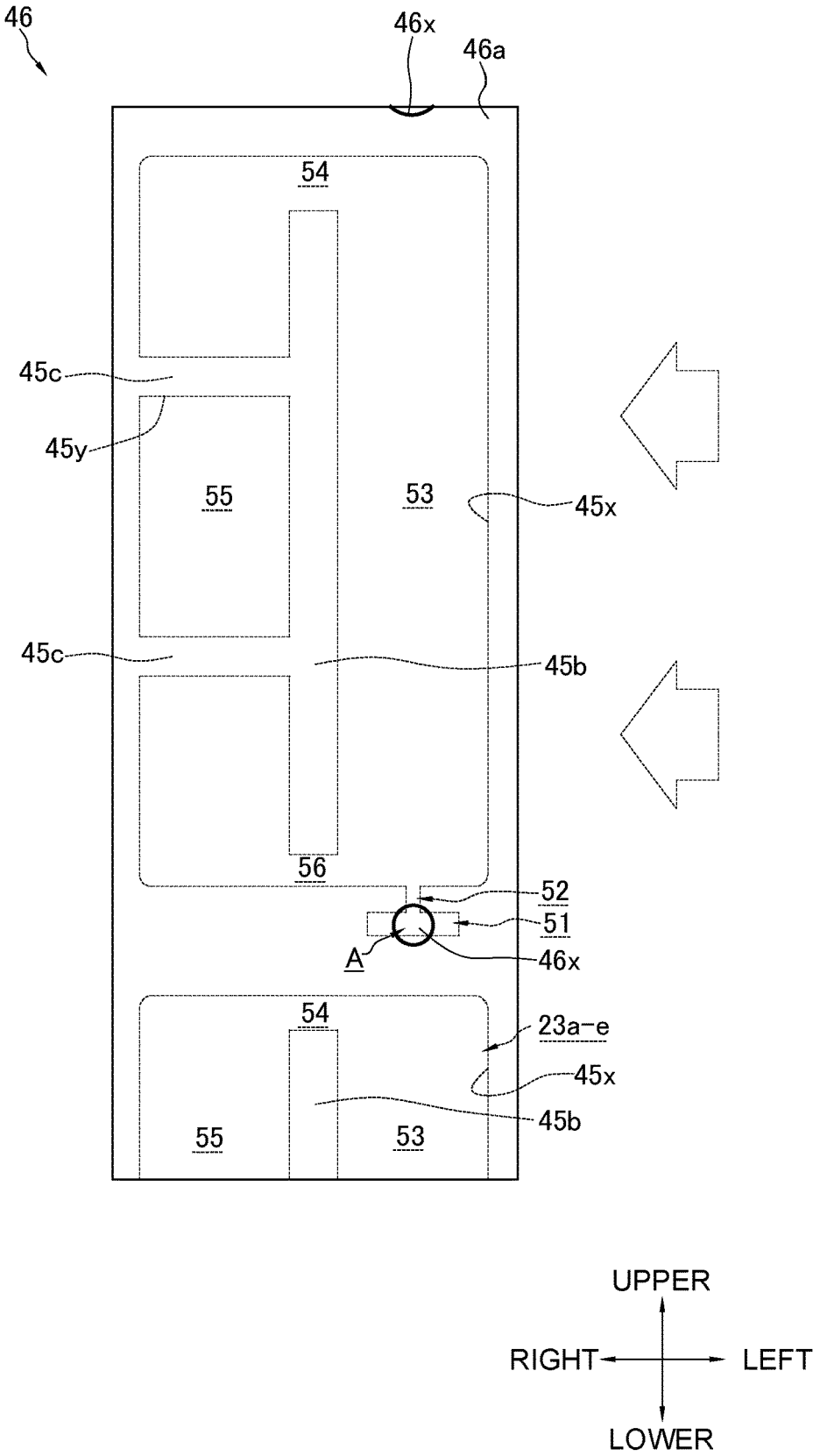
FIG. 16 is a schematic diagram of a rear side of a first liquid-side member according to one or more embodiments.

FIG. 11 is a schematic diagram of a rear side of a second liquid-side member 41. FIG. 12 is a schematic diagram of a rear side of a sixth liquid-side member 42. FIG. 13 is a schematic diagram of a rear side of a fifth liquid-side member 43. FIG. 14 is a schematic diagram of a rear side of a fourth liquid-side member 44. FIG. 15 is a schematic diagram of a rear side of a third liquid-side member 45. FIG. 16 is a schematic diagram of a rear side of a first liquid-side member 46. Each of the above figures depicts a positional relationship among openings in adjacent two of the members in a projected manner, with a broken line and the like.

The liquid header 40 includes the first liquid-side member 46, the second liquid-side member 41, the third liquid-side member 45, the fourth liquid-side member 44, the fifth liquid-side member 43, and the sixth liquid-side member 42. In the liquid header 40, the first liquid-side member 46, the second liquid-side member 41, the third liquid-side member 45, the fourth liquid-side member 44, the fifth liquid-side member 43, and the sixth liquid-side member 42 are joined together by brazing.

The liquid header 40 has a substantially quadrangle outer shape as seen in plan view, and one of the four sides is connected to the flat tubes 28.

(4-1) Second Liquid-Side Member

The second liquid-side member 41 forms an outer shape of the liquid header 40 in conjunction with the first liquid-side member 46 (to be described later). In one or more embodiments, the second liquid-side member 41 has on its surface a cladding layer containing a brazing material.

The second liquid-side member 41 includes a liquid-side flat tube connection plate 41*a*, a first liquid-side outer wall 41*b*, a second liquid-side outer wall 41*c*, a first liquid-side claw 41*d*, and a second liquid-side claw 41*e*.

In one or more embodiments, the second liquid-side member 41 is formed as follows. That is, a sheet metal obtained by rolling is bent in the longitudinal direction of the liquid header 40. However, the method of forming the second liquid-side member 41 is not limited thereto. The second liquid-side member 41 has a uniform thickness that is a first liquid-side thickness.

The liquid-side flat tube connection plate 41*a* (which is an example of a second plate-shaped portion) has a flat plate shape expanding in the up-and-down direction (which is an example of a first direction) and in the left-and-right direction (which is an example of a second direction). The liquid-side flat tube connection plate 41*a* has a plurality of liquid-side flat tube connection openings 41*x* arranged in the up-and-down direction. Each of the liquid-side flat tube connection openings 41*x* is bored through the liquid-side flat tube connection plate 41*a* in the thickness direction. The flat tubes 28 are inserted into the liquid-side flat tube connection openings 41*x* such that the first ends thereof fully pass through the liquid-side flat tube connection openings 41*x*, and are joined to the liquid-side flat tube connection openings 41*x* by brazing. In the state in which the flat tubes 28 are joined to the liquid-side flat tube connection openings 41*x* by brazing, the entire inner peripheral face of each liquid-side flat tube connection opening 41*x* is in contact with the entire outer peripheral face of the corresponding flat tube 28. The first liquid-side thickness, which is the thickness of the second liquid-side member 41 including the liquid-side flat tube connection plate 41*a* is relatively thin and is, for example, within a range from about 1.0 mm or more to about 2.0 mm or less. This configuration therefore reduces a length of the inner peripheral face of each liquid-side flat tube connection opening 41*x* in the thickness direction. In inserting each flat tube 28 into the corresponding liquid-side flat tube connection opening 41*x* before joining the flat tube 28 and the liquid-side flat tube connection opening 41*x* together by brazing, this configuration reduces friction between the inner peripheral face of the liquid-side flat tube connection opening 41*x* and the outer peripheral face of the flat tube 28, which facilitates the inserting work.

The first liquid-side outer wall 41*b* has a planar shape and extends frontward from a front face of a left end of the liquid-side flat tube connection plate 41*a* (i.e., the outer side of the outdoor unit 2, the side farther from the gas header 70).

The second liquid-side outer wall 41*c* has a planar shape and extends frontward from a front face of a right end of the liquid-side flat tube connection plate 41*a* (i.e., the inner side of the outdoor unit 2, the side closer to the gas header 70).

The first liquid-side claw 41*d* protrudes rightward from a front end of the first liquid-side outer wall 41*b*. The second liquid-side claw 41*e* protrudes leftward from a front end of the second liquid-side outer wall 41*c*.

In a state before the sixth liquid-side member 42, the fifth liquid-side member 43, the fourth liquid-side member 44, the third liquid-side member 45, and the first liquid-side member 46 are placed inside the second liquid-side member 41 as seen in plan view, the first liquid-side claw 41*d* extends on the extension of the first liquid-side outer wall 41*b*, and the second liquid-side claw 41*e* extends on the extension of the second liquid-side outer wall 41*c*. In the state in which the sixth liquid-side member 42, the fifth liquid-side member 43, the fourth liquid-side member 44, the third liquid-side member 45, and the first liquid-side member 46 are placed inside the second liquid-side member 41 as seen in plan view, the first liquid-side claw 41*d* and the second liquid-side claw 41*e* are bent to come close to each other. As a result, the sixth liquid-side member 42, the fifth liquid-side member 43, the fourth liquid-side member 44, the third liquid-side member 45, and the first liquid-side member 46 are fixed together by the second liquid-side member 41 crimped. In this state, the sixth liquid-side member 42, the fifth liquid-side member 43, the fourth liquid-side member 44, the third liquid-side member 45, and the first liquid-side member 46 are joined together by brazing in, for example, a furnace. The sixth liquid-side member 42, the fifth liquid-side member 43, the fourth liquid-side member 44, the third liquid-side member 45, and the first liquid-side member 46 are thus completely fixed together. In this state, brazing is performed in a furnace or the like, so that the members are joined by brazing and completely fixed.

(4-2) Sixth Liquid-Side Member

The sixth liquid-side member 42 is stacked on the liquid-side flat tube connection plate 41*a* of the second liquid-side member 41 in contact with a front face of the liquid-side flat tube connection plate 41*a* (on a side closer to a joint between each of the branch liquid-refrigerant connection pipes 49*a* to 49*e* and the liquid header 40). The sixth liquid-side member 42 is similar in left-to-right length to the second liquid-side member 41 excluding two ends of the liquid-side flat tube connection plate 41*a*. In one or more embodiments, the sixth liquid-side member 42 has on its surface a cladding layer containing a brazing material.

The sixth liquid-side member 42 includes a sixth internal plate 42*a* and has a plurality of sixth openings 42*x*.

The sixth internal plate 42*a* (which is an example of a fourth plate-shaped portion) has a flat plate shape expanding in the up-and-down direction and the left-and-right direction.

The sixth openings 42*x* (each of which is an example of a communication opening) are arranged in the up-and-down direction and are bored through the sixth internal plate 42*a* in the thickness direction.

The sixth openings 42*x* are larger than the liquid-side flat tube connection openings 41*x* in the liquid-side flat tube connection plate 41*a* of the second liquid-side member 41. In the state in which the sixth liquid-side member 42 is stacked on the liquid-side flat tube connection plate 41*a* of the second liquid-side member 41, an outer edge of each sixth opening 42*x* is located outward of an outer edge of the corresponding liquid-side flat tube connection opening 41*x* in the liquid-side flat tube connection plate 41*a* of the second liquid-side member 41 in the stacking direction of the members, more specifically in the front-and-rear direction. This configuration suppresses occurrence of a situation in which the brazing material moves by a capillary phenomenon in joining the members together by brazing to close the refrigerant passages 28*b* in the flat tubes 28. From this point of view, upper and lower portions of the outer edge of each sixth opening 42*x* may be separated by 2 mm or more, or in one or more embodiments 3 mm or more, from upper and lower portions of the outer edge of the corresponding liquid-side flat tube connection opening 41*x* in the liquid-side flat tube connection plate 41*a*.

(4-3) Fifth Liquid-Side Member

The fifth liquid-side member 43 is stacked on the sixth liquid-side member 42 in contact with a front face of the sixth liquid-side member 42 (on the side closer to the joint between each of the branch liquid-refrigerant connection pipes 49*a* to 49*e* and the liquid header 40). The fifth liquid-side member 43 is similar in left-to-right length to the sixth liquid-side member 42. In one or more embodiments, the fifth liquid-side member 43 has on its surface a cladding layer containing a brazing material.

The fifth liquid-side member 43 includes a fifth internal plate 43*a* and has a plurality of fifth openings 43*x*.

The fifth internal plate 43*a* (which is an example of a fourth plate-shaped portion) has a flat plate shape expanding in the up-and-down direction and the left-and-right direction. The fifth openings 43*x* (each of which is an example of a communication opening) are arranged in the up-and-down direction and are bored through the fifth internal plate 43*a* in the thickness direction.

Left and right edges of each fifth opening 43*x* are located inward of left and right edges of the corresponding sixth opening 42*x* in the sixth liquid-side member 42, inward of left and right edges of the corresponding liquid-side flat tube connection opening 41*x* in the liquid-side flat tube connection plate 41*a* of the second liquid-side member 41, and inward of a left-to-right width of the corresponding flat tube 28, as seen in the stacking direction. Upper and lower edges of each fifth opening 43*x* are located inward of upper and lower edges of the corresponding sixth opening 42*x* in the sixth liquid-side member 42 and outward of upper and lower edges of the corresponding liquid-side flat tube connection opening 41*x* in the liquid-side flat tube connection plate 41*a* of the second liquid-side member 41 as seen in the stacking direction.

With this configuration, in inserting the flat tubes 28 into the liquid header 40, the vicinities of left and right sides of a distal end of each flat tube 28 come into contact with the edge of the corresponding fifth opening 43*x* in the fifth liquid-side member 43. This configuration therefore suppresses the degree of insertion of each flat tube 28 in the liquid header 40.

(4-4) Fourth Liquid-Side Member

The fourth liquid-side member 44 is stacked on the fifth liquid-side member 43 in contact with a front face of the fifth liquid-side member 43 (on the side closer to the joint between each of the branch liquid-refrigerant connection pipes 49*a* to 49*e* and the liquid header 40). The fourth liquid-side member 44 is similar in left-to-right length to the fifth liquid-side member 43. In one or more embodiments, the fourth liquid-side member 44 has on its surface a cladding layer containing a brazing material.

The fourth liquid-side member 44 includes a fourth internal plate 44*a*, and has a plurality of fourth ascent-side openings 44*x* and a plurality of fourth descent-side openings 44*y*.

The fourth internal plate 44*a* (which is an example of a fourth plate-shaped portion) has a flat plate shape expanding in the up-and-down direction and the left-and-right direction. The fourth internal plate 44*a* also includes a wall 44*aa* where the fourth ascent-side openings 44*x* and the fourth descent-side openings 44*y* are not located. The wall 44*aa* is located at a position overlapping an introduction space 51 of a first through portion 45*x* in the third liquid-side member 45 as seen in the front-and-rear direction.

The fourth ascent-side openings 44*x* (each of which is an example of a communication opening) are arranged in the up-and-down direction and are bored through the fourth internal plate 44*a* in the thickness direction. The fourth ascent-side openings 44*x* are located upstream of the fourth descent-side openings 44*y* in the direction of a flow of air provided by the outdoor fan 16. In FIG. 14, dotted arrows each indicate the flow of the air provided by the outdoor fan 16. Each fourth ascent-side opening 44*x* has an edge located inward of an edge of the corresponding fifth opening 43*x* in the fifth liquid-side member 43 as seen in the stacking direction. With this configuration, the refrigerant flowing through an ascent space 53 (to be described later) is diverted into the fourth ascent-side openings 44*x*, so that the diverted refrigerants flow into the flat tubes 28 connected to the fourth ascent-side openings 44*x*. The fourth ascent-side openings 44*x* are located upstream of the centers of the flat tubes 28 as seen in plan view in the direction of the flow of the air provided by the outdoor fan 16. Therefore, in a case where the outdoor heat exchanger functions as an evaporator for the refrigerant, the refrigerants passing through the fourth ascent-side openings 44*x* are guided to the windward side of the flat tubes 28 in large amounts. As a result, the refrigerants are guided in large amounts to the windward side where a temperature difference between the air and the refrigerant is secured with ease. This configuration thus improves heat exchange performance.

The fourth descent-side openings 44*y* (each of which is an example of an opening) are arranged in the up-and-down direction and are bored through the fourth internal plate 44*a* in the thickness direction. Each fourth descent-side opening 44*y* is located at a position not overlapping the corresponding fifth opening 43*x* in the fifth liquid-side member 43 as seen in the stacking direction. Specifically, each fourth descent-side opening 44*y* is located at a portion overlapping a communication portion 45*c* of the third liquid-side member 45 (to be described later) and between adjacent two of the fifth openings 43*x*, which are arranged in up-and-down direction, in the fifth liquid-side member 43, as seen in the stacking direction. With this configuration, a space in each fifth opening 43*x* in the fifth liquid-side member 43 does not communicate with a space in the corresponding fourth descent-side opening 44*y* in the fourth liquid-side member 44 in the stacking direction. These spaces do not directly communicate with each other. Therefore, the refrigerant flowing through a descent space 55 (to be described later) does not reach the fifth openings 43*x* in the fifth liquid-side member 43 even when the refrigerant moves frontward. Each fourth descent-side opening 44*y* has an upper end located above an upper end of the corresponding communication portion 45*c* which the fourth descent-side opening 44*y* overlaps, as seen in the stacking direction. In addition, each fourth descent-side opening 44*y* has a lower end located below a lower end of the corresponding communication portion 45*c* which the fourth descent-side opening 44*y* overlaps, as seen in the stacking direction.

It should be noted that a plate-shaped portion of the fourth internal plate 44*a* is located between adjacent two of the fourth ascent-side openings 44*x* arranged in the up-and-down direction. Likewise, the plate-shaped portion of the fourth internal plate 44*a* is also located between adjacent two of the fourth descent-side openings 44*y* arranged in the up-and-down direction.

(4-5) Third Liquid-Side Member

The third liquid-side member 45 is stacked on the fourth liquid-side member 44 in contact with a front face of the fourth liquid-side member 44 (on the side closer to the joint between each of the branch liquid-refrigerant connection pipes 49*a* to 49*e* and the liquid header 40). The third liquid-side member 45 is similar in left-to-right length to the fourth liquid-side member 44. In one or more embodiments, the third liquid-side member 45 has on its surface a cladding layer containing a brazing material.

The third liquid-side member 45 includes a third internal plate 45*a* and has a plurality of first through portions 45*x* and a plurality of second through portions 45*y*.

The third internal plate 45*a* (which is an example of a third plate-shaped portion and an example of a portion that is in contact with a partition portion) has a flat plate shape expanding in the up-and-down direction and the left-and-right direction. The third internal plate 45*a* includes partition portions 45*b* extending in the longitudinal direction of the liquid header 40. Each partition portion 45*b* is located in the corresponding first through portion 45*x* with a clearance between its upper end and an upper end of the first through portion 45*x* and a clearance between its lower end and a lower end of the first through portion 45*x*. Each partition portion 45*b* partitions the corresponding first through portion 45*x* into a left space and a right space.

The third internal plate 45*a* also includes communication portions 45*c*. The communication portions 45*c* are located on the downstream side of the direction of the flow of the air provided by the outdoor fan 16, and extend from the vicinity of the right edge of the third internal plate 45*a* to the corresponding partition portion 45*b*. In one or more embodiments, two communication portions 45*c*, which are arranged in the up-and-down direction, protrude from one partition portion 45*b*. The third internal plate 45*a*, which includes the partition portions 45*b* and the communication portions 45*c*, has a uniform thickness in the thickness direction. The communication portions 45*c* and the fourth descent-side openings 44*y* partially overlap each other as seen in the stacking direction. Specifically, the third liquid-side member 45 and the fourth liquid-side member 44 are disposed such that, as seen in the stacking direction, an upper bypass opening 44*p* located above each communication portion 45*c* is defined in an upper region of the corresponding fourth descent-side opening 44*y*, and a lower bypass opening 44*q* located below the communication portion 45*c* is defined in a lower region of the fourth descent-side opening 44*y*.

The first through portions 45*x* (each of which is an example of a refrigerant flow path formation opening) are arranged in the up-and-down direction and are bored through the fourth internal plate 44*a* in the thickness direction. One first through portion 45*x* overlaps the plurality of fourth ascent-side openings 44*x* as seen in the stacking direction.

One first through portion 45*x* includes one introduction space 51 (which is an example of a communication region), one nozzle 52 (which is an example of a connection region), one ascent space 53 (which is an example of a first region), one supply flow path 54 (which is an example of a second region), a part of one descent space 55 (which is an example of a third region), and one return flow path 56 (which is an example of a fourth region). The fourth descent-side openings 44*y* in the fourth liquid-side member 44 form the remaining part of the descent space 55. The nozzle 52 is located below a portion of the fourth liquid-side member 44 communicating with the first through portion 45*x* including the nozzle 52.

Each of the nozzle 52, the supply flow path 54, and the return flow path 56 is a space defined by a rear face of a liquid-side external plate 46*a* of the first liquid-side member 46 (to be described later) and a front face of the fourth internal plate 44*a* of the fourth liquid-side member 44. The introduction space 51 has a rear side covered with a front face of the wall 44*aa* of the fourth internal plate 44*a* of the fourth liquid-side member 44, and a front side communicating with a corresponding one of the branch liquid-refrigerant connection pipes 49*a* to 49*e* connected to external liquid pipe connection openings 46*x* in the liquid-side external plate 46*a* of the first liquid-side member 46 (to be described later). The ascent space 53 has a front side covered with the rear face of the liquid-side external plate 46*a* of the first liquid-side member 46 (to be described later), and a rear side covered with the front face of the fourth internal plate 44*a* of the fourth liquid-side member 44 except a portion where the fourth ascent-side openings 44*x* in the fourth liquid-side member 44 are located. The fourth ascent-side openings 44*x* in the fourth liquid-side member 44 communicate with the ascent space 53 in the third liquid-side member 45, but do not communicate with the introduction space 51, the nozzle 52, the supply flow path 54, the descent space 55, and the return flow path 56 in the third liquid-side member 45.

The descent space 55 has a front side covered with the rear face of the liquid-side external plate 46*a* of the first liquid-side member 46 (to be described later) and the communication portions 45*c* of the fourth liquid-side member 44. The descent space 55 has a rear side that is covered with the front face of the fourth internal plate 44*a* of the fourth liquid-side member 44 at a position where the fourth descent-side openings 44*y* are not located and is covered with the front face of the fifth internal plate 43*a* of the fifth liquid-side member 43 at a position where the fourth descent-side openings 44*y* in the fourth liquid-side member 44 are located.

As described above, the liquid header 40 has a circulation flow path structure made up of the set of introduction space 51, nozzle 52, ascent space 53, supply flow path 54, descent space 55, and return flow path 56, in the space defined by the first liquid-side member 46 and the fifth liquid-side member 43 in the stacking direction. The circulation flow path structures are arranged in the up-and-down direction and are brought into one-to-one correspondence with the branch liquid-refrigerant connection pipes 49*a* to 49*e*.

The introduction space 51, the nozzle 52, and the ascent space 53 are arranged in the longitudinal direction of the liquid header 40. In one or more embodiments, the introduction space 51, the nozzle 52, and the ascent space 53 are arranged in this order from below. The nozzle 52 has a left edge that is located rightward of a left edge of the introduction space 51 and is located rightward of a left edge of the ascent space 53. The nozzle 52 has a right edge that is located leftward of a right edge of the introduction space 51 and is located leftward of a right edge of the ascent space 53. The nozzle 52 is narrower in width in the left-and-right direction than the introduction space 51 and the ascent space 53. This configuration thus enables an increase in flow velocity of the refrigerant at the time when the refrigerant flows from the introduction space 51 toward the ascent space 53 through the nozzle 52 having a narrowed sectional area of a passage. As a result, when the refrigerant with increased flow velocity flows into the ascent space 53, the refrigerant reaches the fourth ascent-side openings 44*x* located upwardly away from the nozzle 52.

The introduction space 51 overlaps and is connected to the corresponding one of the branch liquid-refrigerant connection pipes 49*a* to 49*e* at an overlapping point A that includes a center of the introduction space 51 in the left-and-right direction, as seen in the front-and-rear direction. The overlapping point A where the introduction space 51 is connected to the corresponding one of the branch liquid-refrigerant connection pipes 49*a* to 49*e*, the nozzle 52, and the ascent space 53 are arranged in the vertical direction as seen in the front-and-rear direction. Therefore, when the refrigerant flows out of the corresponding one of the branch liquid-refrigerant connection pipes 49*a* to 49*e*, then the refrigerant flows into the center of the introduction space 51 in the left-and-right direction through the external liquid pipe connection opening 46*x*. The refrigerant then flows upward in the vertical direction from the introduction space 51 toward the ascent space 53 through the nozzle 52 without moving in the left-and-right direction or while considerably slightly moving in the left-and-right direction. For example, in a case of a structure that causes the refrigerant to pass the relatively left side of the introduction space 51, the refrigerant concentratedly flows to the upper right after passing through the nozzle 52. In a case of a structure that causes the refrigerant to pass the relatively right side of the introduction space 51, the refrigerant concentratedly flows to the upper left after passing through the nozzle 52. In contrast to these examples, the structure according to one or more embodiments suppresses such a concentrated flow of the refrigerant.

The supply flow path 54 causes an upper end of the ascent space 53 to communicate with an upper end of the descent space 55. The return flow path 56 causes a lower end of the ascent space 53 to communicate with a lower end of the descent space 55.

In one or more embodiments, the supply flow path 54 is larger in area than the return flow path 56 in a case where the liquid header 40 is seen from the left-and-right direction (which is a direction orthogonal to both the stacking direction and the longitudinal direction of the liquid header). Specifically, in one or more embodiments, a width of the supply flow path 54 in the longitudinal direction of the liquid header 40 is wider than a width of the return flow path 56 in the longitudinal direction of the liquid header 40. With this configuration, after the refrigerant flows upward in the ascent space 53 and reaches the vicinity of the upper end of the ascent space 53, the refrigerant readily passes through the supply flow path 54. In one or more embodiments, the return flow path 56 is smaller in area than the supply flow path 54 in a case where the liquid header 40 is seen from the left-and-right direction (which is a direction orthogonal to both the stacking direction and the longitudinal direction of the liquid header). Specifically, in one or more embodiments, the width of the return flow path 56 in the longitudinal direction of the liquid header 40 is narrower than the width of the supply flow path 54 in the longitudinal direction of the liquid header 40. This configuration suppresses a backflow of the refrigerant from the ascent space 53 toward the return flow path 56.

The second through portions 45*y* (each of which is an example of a refrigerant flow path formation opening and an example of an opening that is not in contact with a communication portion) are arranged in the up-and-down direction at the right side corresponding to the downstream side of the direction of the flow of the air provided by the outdoor fan 16, and are bored through the fourth internal plate 44*a* in the thickness direction. One second through portion 45*y* is surrounded by one partition portion 45*b*, two communication portions 45*c* protruding from the partition portion 45*b*, and an edge of the third liquid-side member 45 near a right end of the third internal plate 45*a*.

(4-6) First Liquid-Side Member

The first liquid-side member 46 is stacked on the third liquid-side member 45 in contact with a front face of the third internal plate 45*a*. The first liquid-side member 46 is similar in left-to-right length to the third liquid-side member 45, the fourth liquid-side member 44, the fifth liquid-side member 43, and the sixth liquid-side member 42. The first liquid-side member 46 is similar in left-to-right length to the second liquid-side member 41 excluding the two ends of the liquid-side flat tube connection plate 41*a*.

In one or more embodiments, the first liquid-side member 46 has on its surface a cladding layer containing a brazing material.

The first liquid-side member 46 includes the liquid-side external plate 46*a*.

The liquid-side external plate 46*a* (which is an example of a first plate-shaped portion) has a flat plate shape expanding in the up-and-down direction and the left-and-right direction.

The liquid-side external plate 46*a* has the plurality of external liquid pipe connection openings 46*x* into and to which the branch liquid-refrigerant connection pipes 49*a* to 49*e* are respectively inserted and connected. The external liquid pipe connection openings 46*x* (each of which is an example of a pipe connection opening) are bored through the liquid-side external plate 46*a* in the thickness direction. The external liquid pipe connection openings 46*x* are arranged in the longitudinal direction of the liquid header 40. In one or more embodiments, the external liquid pipe connection openings 46*x* are arranged at a position biased to the windward side of the liquid-side external plate 46*a*, and centers thereof are located immediately below the respective nozzles 52 as seen in the stacking direction.

The branch liquid-refrigerant connection pipes 49*a* to 49*e* thus communicate with the flat tubes 28 via the external liquid pipe connection openings 46*x* in the first liquid-side member 46, the first through portions 45*x* in the third liquid-side member 45, the fourth ascent-side openings 44*x* in the fourth liquid-side member 44, and the fifth openings 43*x* in the fifth liquid-side member 43.

The first liquid-side member 46 has a front face that is held in contact with the first liquid-side claw 41*d* and second liquid-side claw 41*e* of the second liquid-side member 41 crimped.

(4-7) Flow of Refrigerant in Liquid Header

Next, a description will be given of a flow of the refrigerant in the liquid header 40 in a case where the outdoor heat exchanger 11 functions as an evaporator for the refrigerant. It should be noted that the flow of the refrigerant in a case where the outdoor heat exchanger 11 functions as a condenser or a radiator for the refrigerant is approximately opposite in direction to the flow of the refrigerant in a case where the outdoor heat exchanger 11 functions as an evaporator for the refrigerant.

First, the liquid refrigerant or the refrigerant in a gas-liquid two phase is diverted at the shunt 22, and the diverted refrigerants flow through the shunt tubes 22*a* to 22*e*. The refrigerants then flow into the branch liquid-refrigerant connection pipes 49*a* to 49*e*. The refrigerants then flow into the sub-spaces 23*a* to 23*e* in the liquid header 40 through the external liquid pipe connection openings 46*x* in the liquid-side external plate 46*a* of the second liquid-side member 41.

Specifically, the refrigerants flows into the introduction spaces 51 in the third liquid-side member 45 in the sub-spaces 23*a* to 23*e*.

After the refrigerant flows into each introduction space 51, the refrigerant comes into contact with the wall 44*aa* of the fourth internal plate 44*a* of the fourth liquid-side member 44, so that the refrigerant in the gas phase is mixed with the refrigerant in the liquid phase. Thereafter, the refrigerant passes through the nozzle 52 having the narrow flow path, so that the flow velocity is increased. The refrigerant then flows into the ascent space 53. The partition portion 45*b* narrows the left-to-right width of the ascent space 53. Therefore, even in a state in which the small amount of refrigerant circulates through the refrigerant circuit 6, for example, even in a case where the compressor 8 is driven at a low driving frequency, the refrigerant flowing through the ascent space 53 readily reaches the fourth ascent-side openings 44*x* located near the upper end of the ascent space 53. In the ascent space 53, the refrigerant flows toward the vicinity of the upper end of the ascent space 53 while being diverted into the fourth ascent-side openings 44*x*. In a state in which the large amount of refrigerant circulates through the refrigerant circuit 6, for example, in a case where the compressor 8 is driven at a high driving frequency, the large amount of refrigerant reaches the vicinity of the upper end of the ascent space 53. As a result, the refrigerant then reaches the descent space 55 through the supply flow path 54. In the descent space 55, the refrigerant flows downward, passes through the return flow path 56, and returns again to the space below the ascent space 53 and above the nozzle 52. In the ascent space 53, the flow velocity of the refrigerant passing through the nozzle 52 is increased. Therefore, a portion of the ascent space 53 near the return flow path 56 is lower in static pressure than a portion of the descent space 55 near the return flow path 56. Therefore, after the refrigerant flows downward in the descent space 55, the refrigerant readily returns to the ascent space 53 through the return flow path 56. As described above, the ascent space 53, the supply flow path 54, the descent space 55, and the return flow path 56 enable the circulation of the refrigerant. Therefore, the refrigerant, which is diverted into any of the fourth ascent-side openings 44*x* and therefore does not flow upward in the ascent space 53, returns again to the ascent space 53 through the supply flow path 54, the descent space 55, and the return flow path 56. This configuration therefore allows the refrigerant to flow into any of the fourth ascent-side openings 44*x*.

In flowing downward in the descent space 55, the refrigerant mainly passes the region on the right side of the first through portion 45*x* and the second through portion 45*y* in the third internal plate 45*a* of the third liquid-side member 45. More specifically, in flowing downward in the descent space 55, the refrigerant passes the region between the rear face of the liquid-side external plate 46*a* of the first liquid-side member 46 and the front face of the fourth internal plate

44*a* of the fourth liquid-side member 44, at positions where the communication portions 45*c* are not located. On the other hand, the refrigerant detours around the communication portions 45*c* at positions where the communication portions 45*c* are located. In detouring around the communication portions 45*c*, the refrigerant flows into the fourth descent-side openings 44*y* in the fourth liquid-side member 44 through the upper bypass openings 44*p*, and then returns to the first through portion 45*x* or second through portion 45*y* in the third liquid-side member 45 through the lower bypass openings 44*q*.

As described above, when the diverted refrigerants flow through the fourth ascent-side openings 44*x* in the fourth liquid-side member 44, then the diverted refrigerants flow through the fifth openings 43*x* in the fifth liquid-side member 43 while being kept diverted. Thereafter, the diverted refrigerants flow into the flat tubes 28.

(5) Features of Embodiments (5-1)

In the liquid header 40 of the outdoor heat exchanger 11 according to one or more embodiments, the plate-shaped portions of the respective members are stacked on top of each other, so that the liquid-side internal space 23 is divided into the sub-spaces 23*a* to 23*e* arranged in the up-and-down direction. This configuration eliminates a necessity of known work for inserting and fixing, for example, a plurality of partition plates expanding horizontally into and to a cylindrical header in order to form a plurality of spaces arranged up and down in the cylindrical header.

As for a known cylindrical header, flat tubes, each of which is a heat transfer tube having a flat shape, are inserted into the cylindrical header such that an end of each flat tube is entirely located in an internal space defined in the cylindrical header. Since the flat tubes are deeply inserted into the cylindrical header, unnecessary spaces, where a refrigerant is apt to be retained, are defined above and below each flat tube in the cylindrical header. The cylindrical header has an inner diameter that is required to hold at least the entire end of each flat tube. Therefore, the space in the cylindrical header tends to increase, which increases a sectional area of a passage through which the refrigerant axially flows in the cylindrical header. This hinders an increase in flow velocity of the refrigerant. This tendency becomes conspicuous particularly when increasing a longitudinal length of each flat tube as seen in sectional view. In view of this, according to one or more embodiments, the flat tubes 28 are inserted into and fixed to the plate-shaped liquid-side flat tube connection plate 41*a* and the plate-shaped sixth internal plate 42*a* in the liquid header 40. This configuration therefore enables a reduction in unnecessary space where a refrigerant is retained. According to this configuration, the size of the space where the refrigerant flows in the longitudinal direction of the liquid header 40 is readily adjusted by simply adjusting the thickness of a plate-shaped member and the size of an opening. This configuration therefore enables a reduction in sectional area of the passage through which the refrigerant flows and an increase in flow velocity of the refrigerant.

In the liquid header 40, each first through portion 45*x* in the third internal plate 45*a* of the third liquid-side member 45 has the ascent space 53 extending in the longitudinal direction of the liquid header 40 and the supply flow path 54 and the return flow path 56 extending in the left-and-right direction different from the longitudinal direction of the liquid header 40 and communicating with the ascent space 53. As described above, a direction in which the refrigerant flows through the liquid header 40 is changed by a shape of a through portion in one plate-shaped member. This configuration therefore enables a reduction in number of plate-shaped members for changing a direction in which the refrigerant flows through the liquid header 40. A reduction in number of plate-shaped members for designing an intended refrigerant flow path facilitates sufficient heat input to the member located relatively inward at the time of brazing, and therefore enhances brazing performance. In addition, since the refrigerant flowing direction is changed by simply changing a shape of a through portion in one plate-shaped member, this configuration improves the degree of freedom in designing a flow path in the liquid header 40.

(5-2)

In the liquid header 40 of the outdoor heat exchanger 11 according to one or more embodiments, the ascent space 53 of each first through portion 45*x* in the third internal plate 45*a* of the third liquid-side member 45 is located closer to one of the sides of the third internal plate 45*a* in the direction perpendicular to the longitudinal direction of the ascent space 53, with respect to the center of the third internal plate 45*a*. Therefore, the opposite side to the ascent space 53 of the third internal plate 45*a* in the direction perpendicular to the longitudinal direction with respect to the center of the third internal plate 45*a* is effectively used for different uses and functions from the use and function of the ascent space 53.

Specifically, this side is effectively used as a region where the partition portion 45*b* and the descent space 55 are located. This configuration thus achieves circulation of the refrigerant in the third internal plate 45*a* of the third liquid-side member 45.

The partition portion 45*b* is provided for reducing the left-to-right width of the ascent space 53. Therefore, even in a state in which the small amount of refrigerant circulates through the refrigerant circuit 6, for example, even in a state in which the small amount of refrigerant is supplied to the liquid header 40, the refrigerant flowing upward in the ascent space 53 is sufficiently supplied to the flat tubes 28 connected in the vicinity of the upper end of the ascent space 53. Alternatively, even in a state in which the large amount of refrigerant circulates through the refrigerant circuit 6, for example, even in a state in which the large amount of refrigerant is supplied to the liquid header 40, the refrigerant, which reaches the upper end of the ascent space 53 without being supplied to the flat tubes 28, is supplied to the flat tubes 28 again through the supply flow path 54, the descent space 55, and the return flow path 56.

(5-3)

In the liquid header 40 of the outdoor heat exchanger 11 according to one or more embodiments, the third internal plate 45*a* of the third liquid-side member 45 has the configuration in which each partition portion 45*b* is integrated with the corresponding communication portions 45*c*. Therefore, even in a case where a flow path for circulation of the refrigerant is formed in the third liquid-side member 45 in the thickness direction, such a flow path is formed with a single member rather than multiple members.

In addition, the fourth descent-side openings 44*y* in the fourth liquid-side member 44 are located opposite the communication portions 45*c* of the third liquid-side member 45. The upper bypass opening 44*p* and the lower bypass opening 44*q* are defined by a part of the contour of each fourth descent-side opening 44*y* and a part of the edge of the corresponding communication portion 45*c*. This configuration prevents the communication portions 45*c* from hindering the flow of circulating refrigerant although each partition portion 45*b* is integrated with the corresponding communication portions 45*c* in the third internal plate 45*a*.

(5-4)

In the liquid header 40 of the outdoor heat exchanger 11 according to one or more embodiments, the refrigerant flowing through each ascent space 53 while being diverted into the fourth ascent-side openings 44*x* largely flows into the flat tubes 28 on the windward side, in a case where the outdoor heat exchanger 11 functions as an evaporator for the refrigerant. Specifically, the flow of air provided by the outdoor fan 16 causes the refrigerant to largely flow into the flat tubes 28 on the windward side. This configuration enables supply of the large amount refrigerant to the windward side where the difference in temperature between the refrigerant and the air is large. This configuration therefore enables improvement in heat exchange performance.

(5-5)

In the liquid header 40 of the outdoor heat exchanger 11 according to one or more embodiments, the front side of each ascent space 53 is covered with the rear face of the liquid-side external plate 46*a* of the first liquid-side member 46. In addition, the rear side of each ascent space 53 is covered with the front face of the fourth internal plate 44*a* of the fourth liquid-side member 44, except the portion where the fourth ascent-side openings 44*x* in the fourth liquid-side member 44 are located. This configuration stably secures the sectional area of the flow path in each ascent space 53 where the refrigerant flows upward, irrespective of the degree of insertion of each flat tube 28 in the liquid header 40.

(5-6)

In the liquid header 40 of the outdoor heat exchanger 11 according to one or more embodiments, the second liquid-side member 41 including the liquid-side flat tube connection plate 41*a* is relatively thin. In inserting each flat tube 28 into the corresponding liquid-side flat tube connection opening 41*x* before joining the flat tube 28 and the liquid-side flat tube connection opening 41*x* together by brazing, this configuration reduces friction between the inner peripheral face of the liquid-side flat tube connection opening 41*x* and the outer peripheral face of the flat tube 28, which facilitates the inserting work.

Although the second liquid-side member 41 including the liquid-side flat tube connection plate 41*a* is thin, the sixth liquid-side member 42 is stacked on the liquid-side flat tube connection plate 41*a* in the thickness direction. This configuration enables pressure resistance strength enhancement to the portion of the liquid header 40 to which the flat tubes 28 are connected.

(6) Modifications (6-1) Modification A

In the liquid header 40 of the outdoor heat exchanger 11 according to the foregoing embodiments, the fourth descent-side openings 44*y* in the fourth liquid-side member 44 are located opposite the communication portions 45*c* of the third liquid-side member 45, and the upper bypass opening 44*p* and the lower bypass opening 44*q* are defined by a part of the contour of each fourth descent-side opening 44*y* and a part of the edge of the corresponding communication portion 45*c*.

Figure 17:
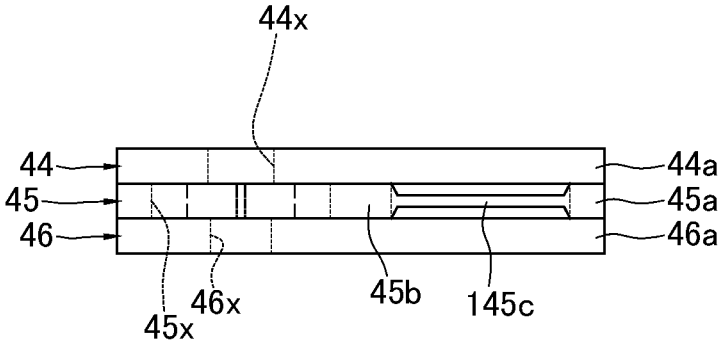
FIG. 17 is a sectional view of a structure around a communication portion of a liquid header according to Modification A as seen in plan view.
Figure 17:
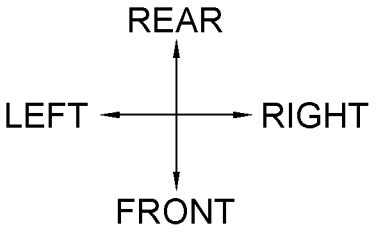

In place of this, as illustrated in FIG. 17, for example, the fourth liquid-side member 44 according to the foregoing embodiments may include a fourth internal plate 44*a* made flat without fourth descent-side openings 44*y*, and the third internal plate 45*a* according to the foregoing embodiments may include communication portions 145*c* that are smaller in thickness than the partition portions 45*b* and other portions. This configuration also enables a flow of the refrigerant through a clearance between each thin communication portion 145*c* and the rear face of the liquid-side external plate 46*a* of the first liquid-side member 46 or the front face of the fourth internal plate 44*a* of the fourth liquid-side member 44.

It should be noted that the third liquid-side member 45 including the thin communication portions 145*c* may be used together with the fourth liquid-side member 44 having the fourth descent-side openings 44*y*. This case enables a more favorable flow of the refrigerant around the communication portions 145*c*.

(6-2) Modification B

In the liquid header 40 of the outdoor heat exchanger 11 according to the foregoing embodiments, the refrigerant circulating in the third liquid-side member 45 is diverted into the fourth ascent-side openings 44*x* in the fourth liquid-side member 44.

Figure 18:
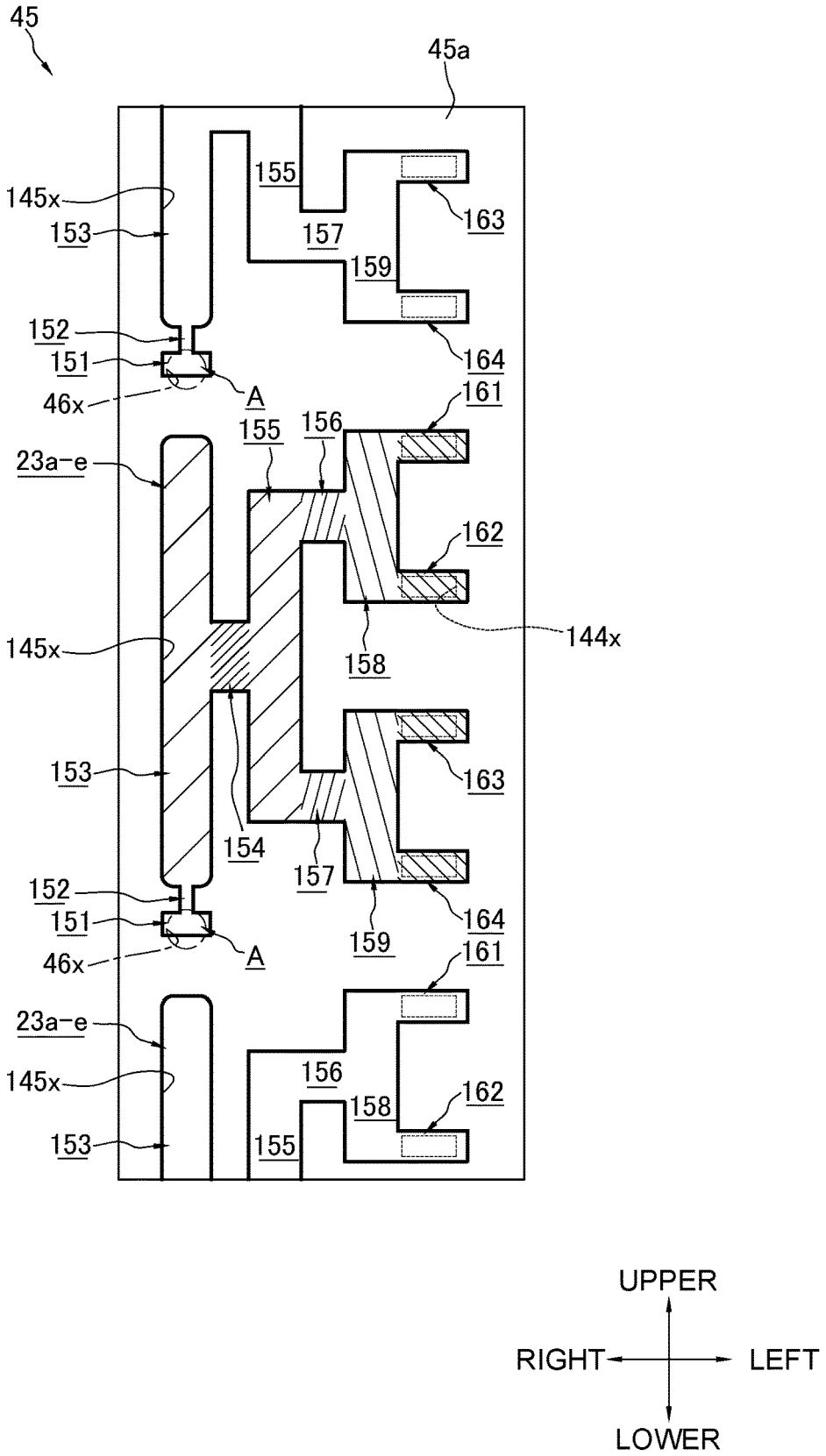
FIG. 18 is a schematic diagram of a rear side of a third liquid-side member according to Modification B.

In place of this, as illustrated in FIG. 18, for example, the liquid header 40 of the outdoor heat exchanger 11 according to the foregoing embodiments may include a fourth liquid-side member 44 including a fourth internal plate 44*a* made flat without fourth descent-side openings 44*y*, and a third liquid-side member 45 having a through portion 145*x* where the refrigerant is diverted as the refrigerant flows upward in an ascent space 153 toward the windward side. FIG. 18 is a schematic diagram of a rear side of the third liquid-side member 45. FIG. 18 illustrates a positional relationship between fourth openings 144*x* (each of which is an example of a communication opening) in the fourth liquid-side member 44 stacked on the rear side of the third liquid-side member 45 and external liquid pipe connection openings 46*x* in a first liquid-side member 46 stacked on a front side of the third liquid-side member 45.

The through portion 145*x* includes an introduction space 151, a nozzle 152, the ascent space 153, a first branch space 154, a first shunt space 155, a second branch space 156, a third branch space 157, a second shunt space 158, a third shunt space 159, a first end 161, a second end 162, a third end 163, and a fourth end 164. In FIG. 18, only a through portion 145*x* at almost the center of the third liquid-side member 45 is hatched for distinguishing the respective spaces and the like from one another.

The introduction space 151 (which is an example of a communication region) extends from a center of the third liquid-side member 45 in an air flowing direction toward the downstream side of a flow of air, which is opposite in direction to that in the introduction space 51 described in the foregoing embodiments. The introduction space 151 partially communicates with the external liquid pipe connection openings 46*x* in the first liquid-side member 46.

The nozzle 152 (which is an example of a connection region) is located above the downstream side of the introduction space 151 in the air flowing direction.

The ascent space 153 (which is an example of a first region) is located above the nozzle 152 and extends upward. As in the foregoing embodiments, when the refrigerant flows into the introduction space 151 through branch liquid-refrigerant connection pipes 49*a* to 49*e*, the refrigerant passes through the nozzle 152 while its flow velocity is increased, and then flows upward in the ascent space 153.

The first branch space 154 (which is an example of a second region) is located at any position of the ascent space 153 in the up-and-down direction, and extends toward the upstream side of the air flowing direction, in a direction different from the direction in which the ascent space 153 extends.

The first shunt space 155 guides, upward and downward, the refrigerant flowing thereinto through the first branch space 154.

The second branch space 156 and the third branch space 157 respectively extend from an upper end and a lower end of the first shunt space 155 toward the upstream side of the air flowing direction.

The second shunt space 158 guides, upward and downward, the refrigerant flowing thereinto through the second branch space 156. The third shunt space 159 guides, upward and downward, the refrigerant flowing thereinto through the third branch space 157.

The first end 161 and the second end 162 respectively extend from an upper end and a lower end of the second shunt space 158 toward the upstream side of the air flowing direction. The third end 163 and the fourth end 164 respectively extend from an upper end and a lower end of the third shunt space 159 toward the upstream side of the air flowing direction.

The first end 161, the second end 162, the third end 163, and the fourth end 164 respectively communicate with the fourth openings 144*x* in the stacking direction.

In the third liquid-side member 45 described above, the through portion 145*x* having the shape branching from the ascent space 153 toward the upstream side of the air flowing direction divides a single refrigerant flow into multiple refrigerant flows.

(6-3) Modification C

In Modification B, when the refrigerant flows into the third liquid-side member 45 through the external liquid pipe connection opening 46*x* in the liquid-side external plate 46*a* of the first liquid-side member 46, then the refrigerant flows toward the first branch space 154 through the introduction space 151, the nozzle 152, and the ascent space 153.

Figure 19:
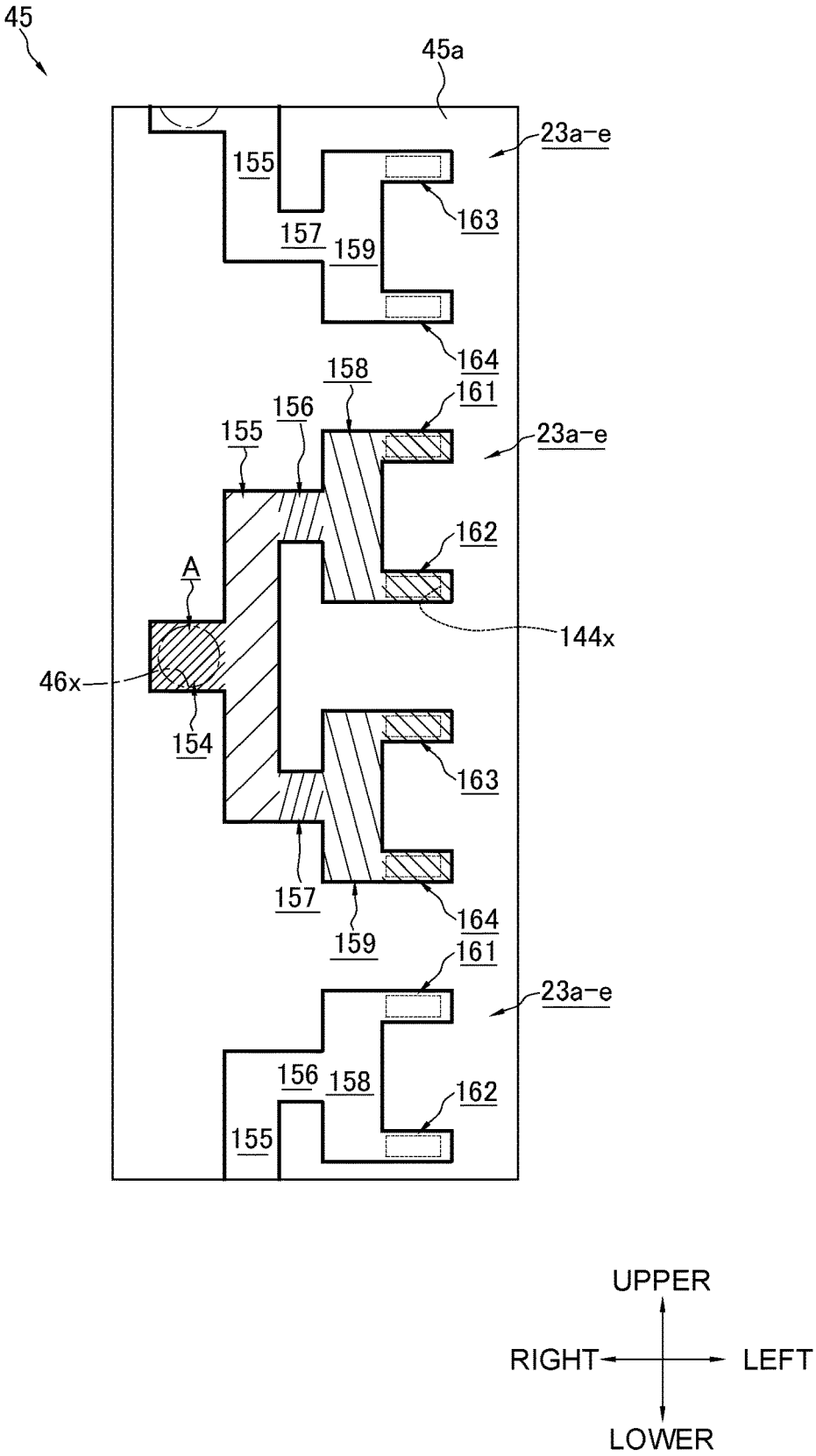
FIG. 19 is a schematic diagram of a rear side of a third liquid-side member according to Modification C.

In place of this, as illustrated in FIG. 19, a third liquid-side member 45 according to Modification C is different from the third liquid-side member 45 according to Modification B in the following respects. That is, the third liquid-side member 45 according to Modification C does not include an introduction space 151, a nozzle 152, and an ascent space 153. When the refrigerant flows into the third liquid-side member 45 through the external liquid pipe connection opening 46*x* in the liquid-side external plate 46*a* of the first liquid-side member 46, then the refrigerant directly flows into a first branch space 154.

In this case, the external liquid pipe connection opening 46*x* in the liquid-side external plate 46*a* of the first liquid-side member 46 overlaps the first branch space 154 in the stacking direction.

(6-4) Modification D

In the foregoing embodiments, in the liquid header 40 of the outdoor heat exchanger 11 functioning as an evaporator for the refrigerant, the refrigerant flows through the first liquid-side member 46, the third liquid-side member 45, the fourth liquid-side member 44, the fifth liquid-side member 43, the sixth liquid-side member 42, and the second liquid-side member 41 in this order.

Figure 20:
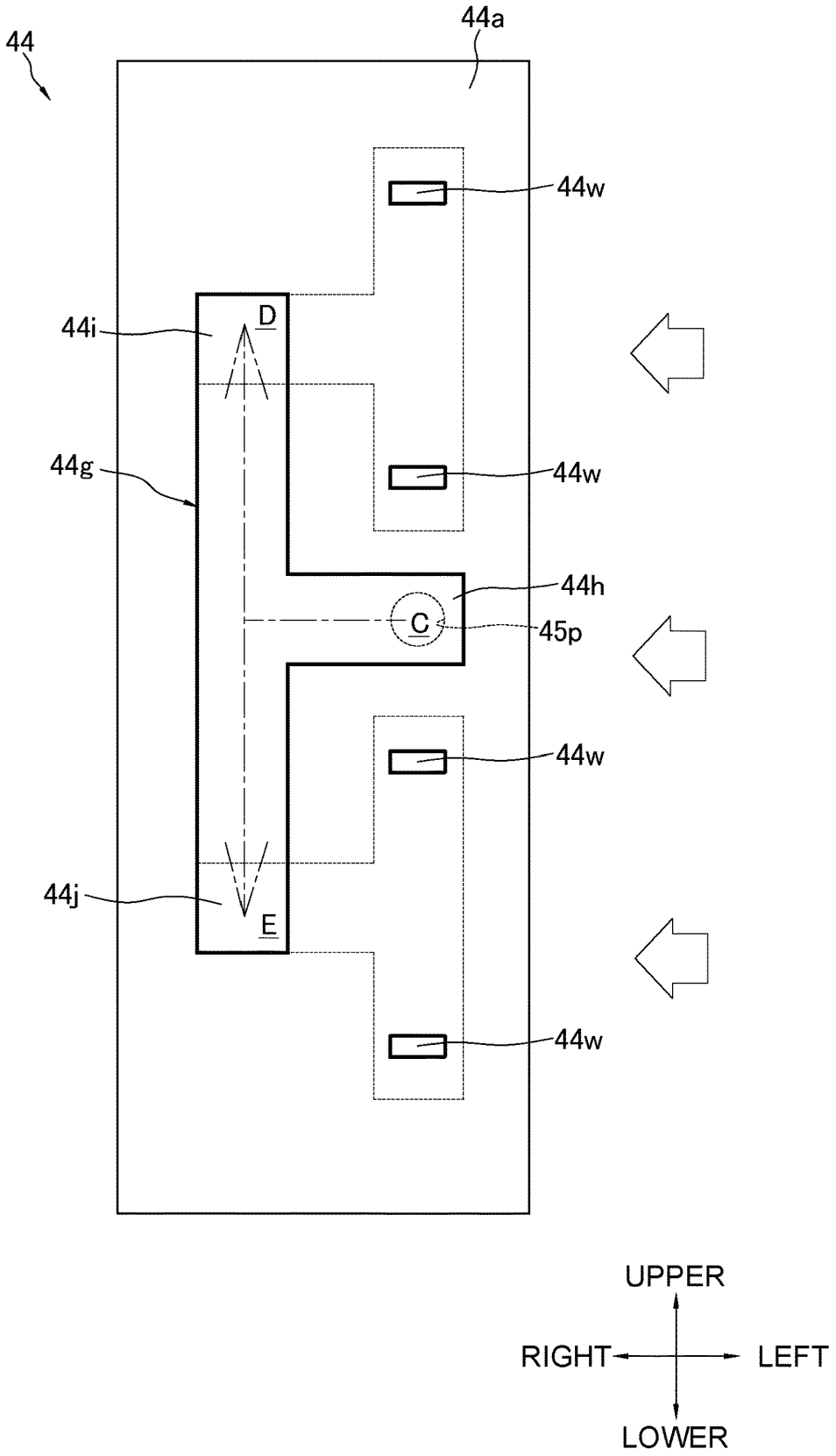
FIG. 20 is a schematic diagram of a rear side of a fourth liquid-side member according to Modification D.
Figure 21:
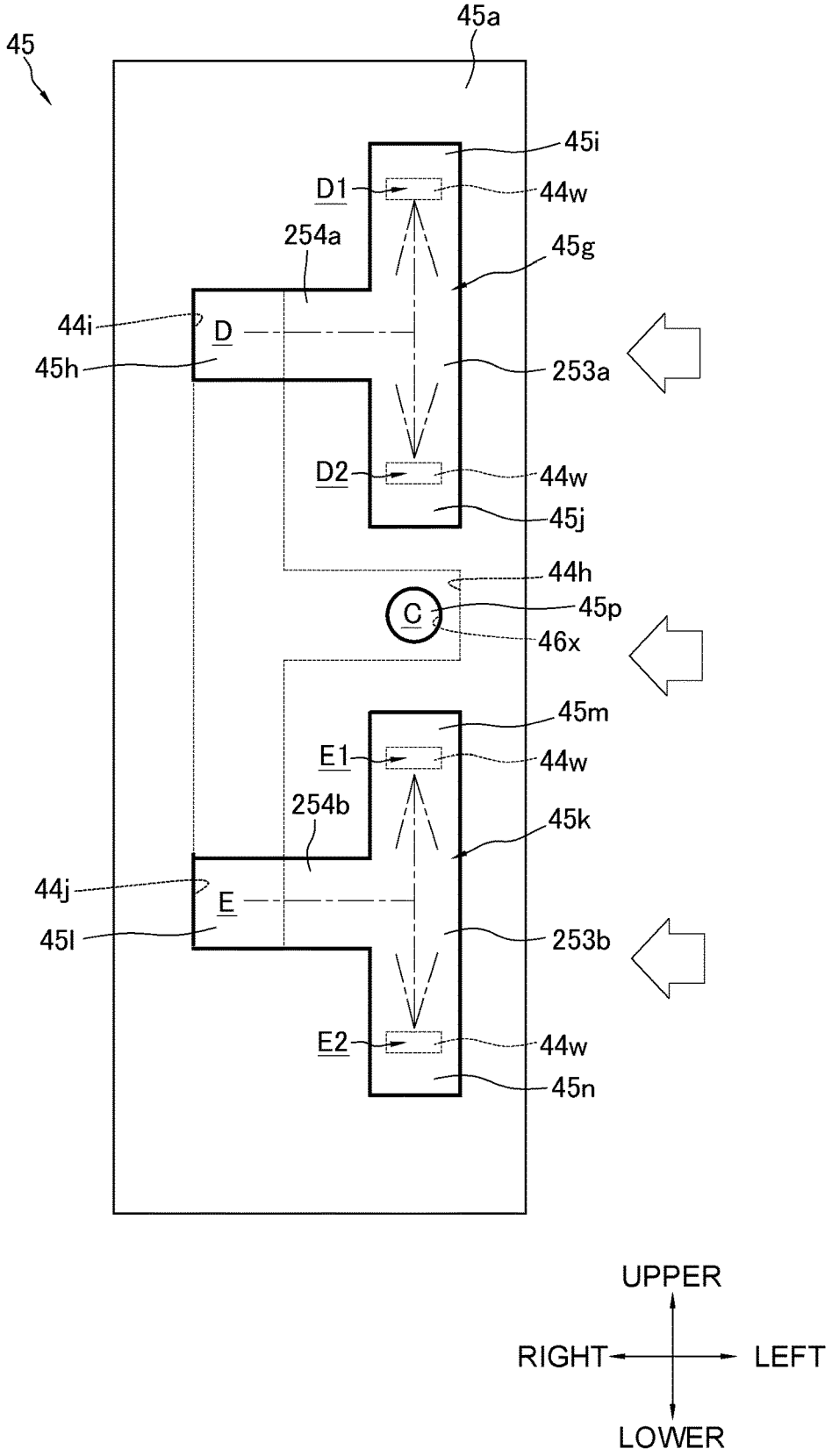
FIG. 21 is a schematic diagram of a rear side of a third liquid-side member according to Modification D.
Figure 22:
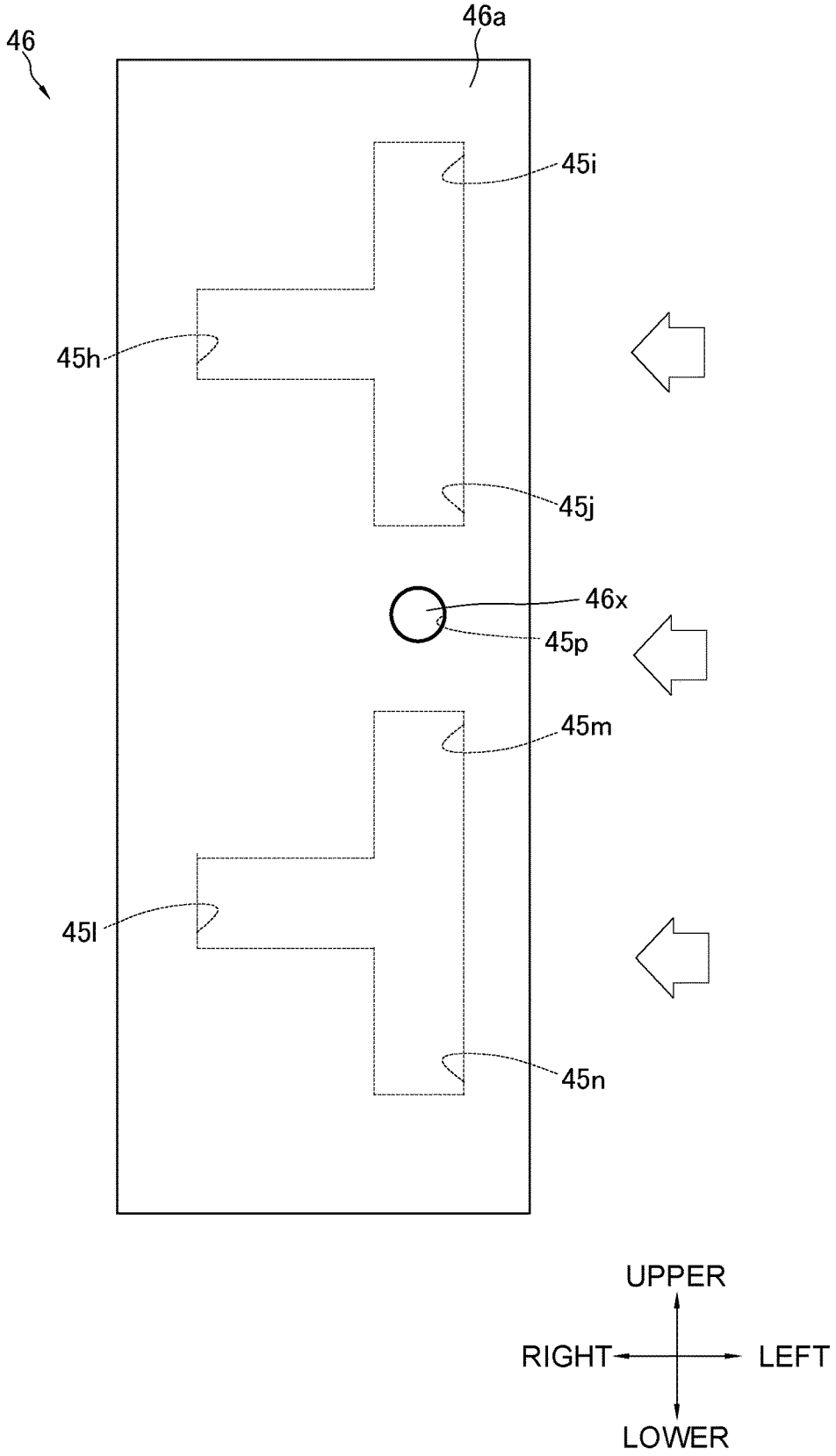
FIG. 22 is a schematic diagram of a rear side of a first liquid-side member according to Modification D.

In place of this, the liquid header 40 may include a fourth liquid-side member 44 illustrated in FIG. 20, a third liquid-side member 45 illustrated in FIG. 21, and a first liquid-side member 46 illustrated in FIG. 22 instead of the fourth liquid-side member 44 in the foregoing embodiments, the third liquid-side member 45 in the foregoing embodiments, and the first liquid-side member 46 in the foregoing embodiments.

The fourth liquid-side member 44 includes a fourth internal plate 44*a* (which is an example of a fourth plate-shaped portion), and has a fourth liquid-side opening 44*g* that does not overlap a plurality of fifth openings 43*x* in a fifth liquid-side member 43, and a plurality of fourth shunt openings 44*w* (each of which is an example of a communication opening) that overlap the respective fifth openings 43*x* in the fifth liquid-side member 43, as seen in the front-and-rear direction (the stacking direction). The fourth liquid-side opening 44*g* and the fourth shunt openings 44*w* do not communicate with each other and are bored independently of each other. The fourth liquid-side opening 44*g* has a portion extending in the up-and-down direction from a region 44*i* to a region 44*j* on the leeward side (the right side), and a portion extending from a center portion of the fourth liquid-side opening 44*g* in the up-and-down direction to a region 44*h* on the windward side (the left side).

The third liquid-side member 45 includes a third internal plate 45*a* (which is an example of a third plate-shaped portion), and has a communication port 45*p*, an upper third liquid-side opening 45*g* (which is an example of a refrigerant flow path formation opening), and a lower third liquid-side opening 45*k* (which is an example of a refrigerant flow path formation opening). The communication port 45*p*, the upper third liquid-side opening 45*g*, and the lower third liquid-side opening 45*k* do not communicate with one another and are bored independently of one another. The communication port 45*p* overlaps the region 44*h* of the fourth liquid-side opening 44*g* in the fourth liquid-side member 44 in an overlapping region C as seen in the front-and-rear direction (the stacking direction). The upper third liquid-side opening 45*g* has a first windward portion 253*a* (which is an example of a first region) extending in the up-and-down direction from a region 45*i* to a region 45*j* on the windward side (the left side), and a first leeward portion 254*a* (which is an example of a second region) extending from a center of the upper third liquid-side opening 45*g* in the up-and-down direction to a region 45*h* on the leeward side (the right side). The lower third liquid-side opening 45*k* has a second windward portion 253*b* (which is an example of a first region) extending in the up-and-down direction from a region 45*m* to a region 45*n* on the windward side (the left side), and a second leeward portion 254*b* (which is an example of a second region) extending from a center of the lower third liquid-side opening 45*k* in the up-and-down direction to a region 45*l* on the leeward side (the right side). The region 45*h* of the upper third liquid-side opening 45*g* overlaps the region 44*i* of the fourth liquid-side opening 44*g* in an overlapping region D as seen in the front-and-rear direction (the stacking direction). The region 45*i* of the upper third liquid-side opening 45*g* overlaps one of the fourth shunt openings 44*w* in an overlapping region D1 as seen in the front-and-rear direction (the stacking direction). The region 45*j* of the upper third liquid-side opening 45*g* overlaps another one of the fourth shunt openings 44*w* in an overlapping region D2 as seen in the front-and-rear direction (the stacking direction). The region 45*l* of the lower third liquid-side opening 45*k* overlaps the region 44*j* of the fourth liquid-side opening 44*g* in an overlapping region E as seen in the front-and-rear direction (the stacking direction). The region 45*m* of the lower third liquid-side opening 45*k* overlaps one of the fourth shunt openings 44*w* in an overlapping region E1 as seen in the front-and-rear direction (the stacking direction). The region 45*n* of the lower third liquid-side opening 45*k* overlaps another one of the fourth shunt openings 44*w* in an overlapping region E2 as seen in the front-and-rear direction (the stacking direction).

The first liquid-side member 46 includes a liquid-side external plate 46*a*, and has an external liquid pipe connection opening 46*x* to which any of the branch liquid-refrigerant connection pipes 49*a* to 49*e* is connected. The external liquid pipe connection opening 46*x* overlaps and communicates with the communication port 45*p* in the third liquid-side member 45 as seen in the front-and-rear direction (the stacking direction).

The refrigerant flows as follows in a case where the outdoor heat exchanger 11 including the liquid header 40 according to Modification D functions as an evaporator for the refrigerant. First, the refrigerant flows through any of the branch liquid-refrigerant connection pipes 49*a* to 49*e*. The refrigerant then flows through the external liquid pipe connection opening 46*x* in the first liquid-side member 46 and the communication port 45*p* in the third liquid-side member 45. The refrigerant then flows into the overlapping region C, that is, the region 44*h* of the fourth liquid-side opening 44*g* in the fourth liquid-side member 44. After the refrigerant flows into the region 44*h* of the fourth liquid-side opening 44*g*, the refrigerant is diverted at the fourth liquid-side opening 44*g*, and the diverted refrigerants flow toward the region 44*i* and the region 44*j*. The refrigerant flowing through the region 44*i* of the fourth liquid-side opening 44*g* flows into the region 45*h* of the upper third liquid-side opening 45*g* in the third liquid-side member 45 in the overlapping region D. After the refrigerant flows into the region 45*h* of the upper third liquid-side opening 45*g*, the refrigerant flows through the first leeward portion 254*a* toward the windward side (the left side) in the upper third liquid-side opening 45*g*. The refrigerant flows through the first windward portion 253*a* while being diverted in the up-and-down direction, and the diverted refrigerants flow toward the region 45*i* and the region 45*j*. The refrigerant flowing through the region 45*i* of the upper third liquid-side opening 45*g* flows into one of the fourth shunt openings 44*w* in the fourth liquid-side member 44 in the overlapping region D1. The refrigerant flowing through the region 45*j* of the upper third liquid-side opening 45*g* flows into another one of the fourth shunt openings 44*w* in the fourth liquid-side member 44 in the overlapping region D2. The refrigerant flowing through the region 44*j* of the fourth liquid-side opening 44*g* flows into the region 45*l* of the lower third liquid-side opening 45*k* in the third liquid-side member 45 in the overlapping region E. After the refrigerant flows into the region 45*l* of the lower third liquid-side opening 45*k*, the refrigerant flows through the second leeward portion 254*b* toward the windward side (the left side) in the lower third liquid-side opening 45*k*. The refrigerant flows through the second windward portion 253*b* while being diverted in the up-and-down direction, and the diverted refrigerants flow toward the region 45*m* and the region 45*n*. The refrigerant flowing through the region 45*m* of the lower third liquid-side opening 45*k* flows into one of the fourth shunt openings 44*w* in the fourth liquid-side member 44 in the overlapping region E1. The refrigerant flowing through the region 45*n* of the lower third liquid-side opening 45*k* flows into another one of the fourth shunt openings 44*w* in the fourth liquid-side member 44 in the overlapping region E2. After the refrigerants flow through the fourth shunt openings 44*w* in the fourth liquid-side member 44, the refrigerants flow into the flat tubes 28 through the fifth openings 43*x* in the fifth liquid-side member 43 and the sixth openings 42*x* in the sixth liquid-side member 42.

As described above, in the liquid header 40, when the refrigerant flows through the third liquid-side member 45, the refrigerant flows through the fourth liquid-side member 44, and then returns to the third liquid-side member 45. The refrigerant then flows through the fourth liquid-side member 44 again. As described above, the refrigerant is supplied and returned multiple times to the respective plate-shaped members through the overlapping regions C, D, E, D1, D2, E1, and E2. This configuration therefore enables effective mixing of the liquid refrigerant with the gas refrigerant.

In a case where the number of branched flow paths increases toward one side of the plate-shaped members in the stacking direction, the refrigerant flows toward the one side, so that the refrigerant is apt to be retained at the one side. In contrast to this, in the liquid header 40 according to Modification D, the refrigerant flow paths are branched such that the refrigerant is supplied and returned multiple times to the respective plate-shaped members. This configuration therefore enables diverting of the refrigerant without retention of the refrigerant.

(6-5) Modification E

In the foregoing embodiments, the fourth liquid-side member 44 on the rear side of the third liquid-side member 45 has the plurality of fourth descent-side openings 44*y* in order to allow the refrigerant to detour around the positions where the communication portions 45*c* of each first through portion 45*x* in third internal plate 45*a* are located.

Figure 23:
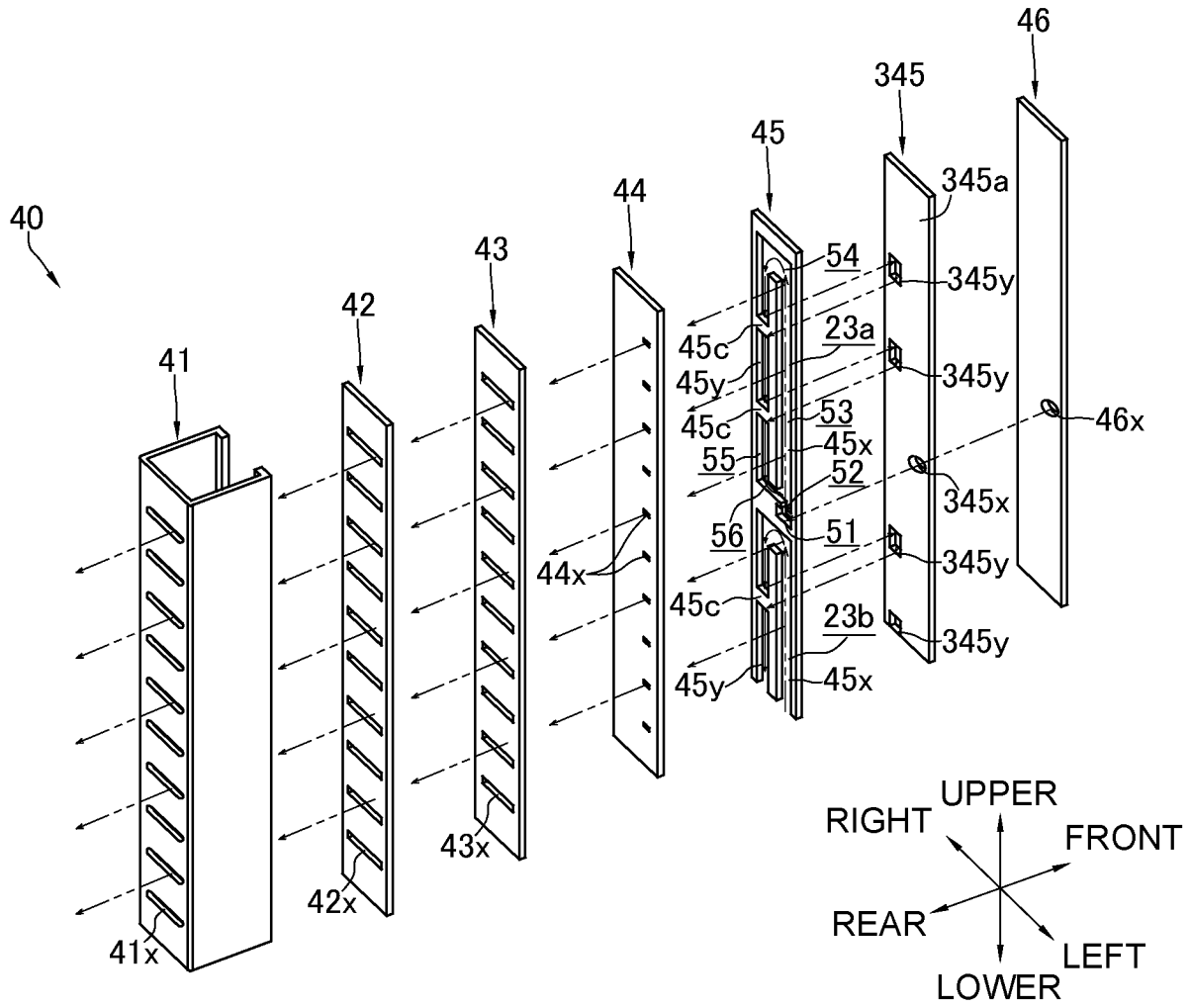
FIG. 23 is an exploded perspective view of a liquid header according to Modification E.

In place of this, as illustrated in FIG. 23, for example, in a case where a seventh liquid-side member 345 including a seventh plate-shaped portion 345*a* is disposed between a third liquid-side member 45 and a first liquid-side member 46, a fourth liquid-side member 44 does not have a plurality of fourth descent-side openings 44*y* unlike the fourth liquid-side member 44 in the foregoing embodiments, but the seventh liquid-side member 345 may have a plurality of descent-side openings 345*y*.

As in the foregoing embodiments, this configuration also allows the refrigerant to detour around communication portions 45*c* while achieving a structure of the third liquid-side member 45 in which a partition portion 45*b* is integrated with the communication portions 45*c*.

(6-6) Modification F

In the foregoing embodiments, the liquid header 40 includes the third liquid-side member 45 including the third internal plate 45*a* in which each partition portion 45*b* is integrated with the corresponding communication portions 45*c*.

In place of this, each partition portion 45*b* in the foregoing embodiments may be provided in, for example, the first liquid-side member 46 or the fourth liquid-side member 44 adjoining the third liquid-side member 45, instead of the third liquid-side member 45.

For example, a member having a shape corresponding to each partition portion 45*b* may be fixed by, for example, welding to the rear face of the liquid-side external plate 46*a* of the first liquid-side member 46 before the first liquid-side member 46 is stacked. Alternatively, a member having a shape corresponding to each partition portion 45*b* may be fixed by, for example, welding to the front face of the fourth internal plate 44*a* of the fourth liquid-side member 44 before the fourth liquid-side member 44 is stacked. For example, a protrusion having a shape corresponding to each partition portion 45*b* may be formed by pressing a part of the liquid-side external plate 46*a* of the first liquid-side member 46 from the front side toward the rear side. Alternatively, a protrusion having a shape corresponding to each partition portion 45*b* may be formed by pressing a part of the fourth internal plate 44*a* of the fourth liquid-side member 44 from the rear side toward the front side.

These configurations eliminate a necessity of the communication portions 45*c* integrally holding the partition portions 45*b* in the third internal plate 45*a*. These configurations also eliminate a necessity of the fourth descent-side openings 44*y* bored in the fourth liquid-side member 44 so as to cause the refrigerant to detour around the communication portions 45*c*.

(6-7) Modification G

In the foregoing embodiments and the foregoing modifications, one heat transfer tube group including a plurality of heat transfer tubes arranged in a direction crossing an air flowing direction is provided in the air flowing direction.

However, a heat transfer tube for a heat exchanger is not limited thereto. For example, multiple heat transfer tube groups each including a plurality of heat transfer tubes arranged in a direction crossing an air flowing direction may be arranged in the air flowing direction. In one or more embodiments, multiple refrigerant flow paths are also arranged in the air flowing direction in a liquid header.

(6-8) Modification H

In the foregoing embodiments and the foregoing modifications, the ascent space 53 of each first through portion 45*x* in the third internal plate 45*a* extends in the up-and-down direction (which is an example of a first direction) to allow the refrigerant to flow in the up-and-down direction, and the supply flow path 54 and return flow path 56 of each first through portion 45*x* in the third internal plate 45*a* extend in the left-and-right direction (which is an example of a second direction) to allow the refrigerant to flow in the left-and-right direction.

However, the first direction is not limited to the up-and-down direction, and the second direction is not limited to the left-and-right direction. For example, the first direction may be the left-and-right direction, and the second direction may be the up-and-down direction. In addition, the first direction and the second direction are not necessarily orthogonal to each other.

(7) Other Modifications

A shape of a member that includes the first plate-shaped portion is not limited as long as the first plate-shaped portion has a plate shape. For example, the member may entirely or partially have a plate shape. The same thing may hold true for a member that includes the second plate-shaped portion, a member that includes the third plate-shaped portion, and a member that includes the fourth plate-shaped portion. That is, each member may entirely or partially have a plate shape.

In one or more embodiments, the first plate-shaped portion, the second plate-shaped portion, the third plate-shaped portion, and the fourth plate-shaped portion each have the same thickness direction, and are stacked in the thickness direction.

These plate-shaped portions are not necessarily stacked each other in a state in which adjacent two of the plate-shaped portions are in direct contact with each other. For example, these plate-shaped portions may be stacked each other with a different plate-shaped portion interposed between adjacent two of the plate-shaped portions.

In one or more embodiments, the header has refrigerant flow paths on a first side of the refrigerant flow path formation opening in the third plate-shaped portion in a refrigerant flowing direction and refrigerant flow paths on a second side of the refrigerant flow path formation opening in the third plate-shaped portion in the refrigerant flowing direction, and the refrigerant flow paths on the first side are different in number by 3 times or more from the refrigerant flow paths on the second side.

In one or more embodiments, the first region has a longitudinal direction parallel to a longitudinal direction of the header and a vertical direction.

In one or more embodiments, the first region extends in the first direction perpendicular to the stacking direction. In one or more embodiments, the first direction is parallel to the longitudinal direction of the header. In one or more embodiments, the second region extends in the second direction perpendicular to the stacking direction and different from the first direction. In one or more embodiments, the second direction is perpendicular to the longitudinal direction of the header.

In one or more embodiments, the communication openings in the fourth plate-shaped portion are arranged in the first direction.

In one or more embodiments, the communication openings in the fourth plate-shaped portion are brought into one-to-one correspondence with the heat transfer tubes.

In one or more embodiments, the communication openings are arranged at a position biased to a side of a position off a center of the fourth plate-shaped portion in the direction perpendicular to both the stacking direction and the direction in which the heat transfer tubes are arranged. In one or more embodiments, the communication openings are arranged at a position off a center of the fourth plate-shaped portion in the second direction.

In the heat exchanger, the communication openings are arranged at a position biased to the direction in the fourth plate-shaped portion. This configuration enables effective utilization of a region, where no communication openings are located, in the fourth plate-shaped portion. The effective utilization as used herein is not limited. For example, a refrigerant flow path may be formed on this region. Alternatively, this region may serve as a closing portion for closing an opening in an adjacent member to the fourth plate-shaped portion.

In one or more embodiments, the first pipe communicates with the heat transfer tubes via the first region of the refrigerant flow path formation opening in the third plate-shaped portion on a shortest route of the refrigerant flow paths in the header.

In one or more embodiments, the first region is located at a position off a center of the third plate-shaped portion in the direction perpendicular to both the stacking direction and the direction in which the heat transfer tubes are arranged or at a position off a center of the third plate-shaped portion in the second direction. This configuration secures a wide region on a side, where the first region is not located, of the third plate-shaped portion in the second direction, and enables effective utilization of the wide region. The effective utilization as used herein is not limited. For example, a refrigerant flow path may be formed on this region. Alternatively, this region may serve as a closing portion for closing an opening in an adjacent member to the third plate-shaped portion.

In one or more embodiments, the minimum width of the connection region is narrower than a maximum width of the first region in the direction perpendicular to both the stacking direction and the first direction.

In one or more embodiments, the connection region overlaps a region obtained by virtually extending a joint between the first plate-shaped portion and the first pipe in the stacking direction, as seen in the longitudinal direction of the header.

In the fourth plate-shaped portion, the communication openings are not located in the wall.

In one or more embodiments, the communication openings in the fourth plate-shaped portion are located at a position off the joint between the first plate-shaped portion and the first pipe in the first direction, as seen in the stacking direction. In one or more embodiments where the first direction is parallel to the vertical direction, the communication openings in the fourth plate-shaped portion are located above the joint between the first plate-shaped portion and the first pipe as seen in the stacking direction.

In one or more embodiments, each of the flat tubes has a flat face. In one or more embodiments, each of the flat tubes has a width in the first direction and a width in the second direction, and the width in the first direction is narrower than the width in the second direction as seen in a sectional view. In one or more embodiments, each of the flat tubes includes a plurality of refrigerant flow paths arranged in the air flowing direction.

(8)

Although the disclosure has been described with respect to only a limited number of embodiments, those skilled in the art, having benefit of this disclosure, will appreciate that various other embodiments may be devised without departing from the scope of the present disclosure. Accordingly, the scope of the disclosure should be limited only by the attached claims.

REFERENCE SIGNS LIST

1: air conditioning apparatus (heat pump apparatus)
11: outdoor heat exchanger (heat exchanger)
16: outdoor fan (fan)
19: first gas-refrigerant pipe
28: flat tube (heat transfer tube)
40: liquid header (header)
41: second liquid-side member
41*a*: liquid-side flat tube connection plate (second plate-shaped portion)
41*x*: liquid-side flat tube connection opening
42: sixth liquid-side member
42*a*: sixth internal plate (fourth plate-shaped portion)
42*x*: sixth opening (communication opening)
43: fifth liquid-side member
43*a*: fifth internal plate (fourth plate-shaped portion)
43*x*: fifth opening (communication opening)
44: fourth liquid-side member
44*a*: fourth internal plate (fourth plate-shaped portion, portion that is in contact with partition portion)
44*aa*: wall
44*p*: upper bypass opening
44*q*: lower bypass opening
44*x*: fourth ascent-side opening (communication opening)
44*y*: fourth descent-side opening (opening)
44*w*: fourth shunt opening (communication opening)
45: third liquid-side member
45*a*: third internal plate (third plate-shaped portion, portion that is in contact with partition portion)
45*b*: partition portion
45*c*: communication portion
45*g*: upper third liquid-side opening (refrigerant flow path formation opening)
45*k*: lower third liquid-side opening (refrigerant flow path formation opening)
45*x*: first through portion (refrigerant flow path formation opening)
45*y*: second through portion (refrigerant flow path formation opening, opening over communication portion)
46: first liquid-side member
46*a*: liquid-side external plate (first plate-shaped portion)
46*x*: external liquid pipe connection opening (pipe connection opening)
49*a* to 49*e*: branch liquid-refrigerant connection pipe (first pipe)
51: introduction space (communication region)
52: nozzle (connection region)
53: ascent space (first region)
54: supply flow path (second region)
55: descent space (third region)
56: return flow path (fourth region)
70: gas header
144*x*: fourth opening (communication opening)
145*c*: communication portion
145*x*: through portion (refrigerant flow path formation opening)
151: introduction space (communication region)
152: nozzle (connection region)
153: ascent space (first region)
154: first branch space (second region)
253*a*: first windward portion (first region)
253*b*: second windward portion (first region)
254*a*: first leeward portion (second region)
254*b*: second leeward portion (second region)
345: seventh liquid-side member (fifth plate-shaped portion)
345*a*: seventh plate-shaped portion (portion that is in contact with partition portion)
345*y*: descent-side opening (opening over communication portion)
A: overlapping point

The invention claimed is:

1. A heat exchanger connected to a first pipe through which a refrigerant flows, the heat exchanger comprising:
heat transfer tubes; and
a header connected to the heat transfer tubes, wherein
the header includes:
a first plate-shaped portion connected to the first pipe;
a second plate-shaped portion connected to the heat transfer tubes;
a third plate-shaped portion disposed between the first plate-shaped portion and the second plate-shaped portion; and
a fourth plate-shaped portion that is disposed between the third plate-shaped portion and the second plate-shaped portion and that has communication openings for the heat transfer tubes,
the first plate-shaped portion, the third plate-shaped portion, the fourth plate-shaped portion, and the second plate-shaped portion are stacked and overlap in a stacking direction,
the third plate-shaped portion has a refrigerant flow path formation opening including:
a first region through which the refrigerant flows in a first direction perpendicular to the stacking direction; and
a second region through which the refrigerant flows in a second direction that is perpendicular to the stacking direction and that is different from the first direction,
the first pipe communicates with the heat transfer tubes via the refrigerant flow path formation opening in the third plate-shaped portion and the communication openings in the fourth plate-shaped portion,
the third plate-shaped portion and the fourth plate-shaped portion are stacked in contact with each other,
the communication openings overlap the first region in the stacking direction, and
the communication openings in the fourth plate-shaped portion are arranged at a position biased to a windward side of a direction perpendicular to both the stacking direction and a direction in which the heat transfer tubes are arranged.

2. The heat exchanger according to claim 1, wherein the first plate-shaped portion has a pipe connection opening that is connected to the first pipe, the refrigerant flow path formation opening in the third plate-shaped portion further includes a communication region and a connection region, the connection region connects the first region or the second region and the communication region, and the communication region includes an overlapping point that overlaps the pipe connection opening in the first plate-shaped portion in the stacking direction.

3. The heat exchanger according to claim 2, wherein the communication region and the first region are arranged in the first direction, and the connection region has a minimum width narrower than a maximum width of the communication region in a direction perpendicular to both the stacking direction and the first direction.

4. The heat exchanger according to claim 2, wherein the overlapping point, the connection region, and the first region are arranged in the first direction.

5. The heat exchanger according to claim 1, wherein the fourth plate-shaped portion includes a wall disposed at a position that overlaps a joint between the first plate-shaped portion and the first pipe in the stacking direction, and the communication openings in the fourth plate-shaped portion are disposed apart from the joint between the first plate-shaped portion and the first pipe as seen in the stacking direction.

6. The heat exchanger according to claim 1, wherein the first plate-shaped portion and the fourth plate-shaped portion define a space including:

the first region;

a third region juxtaposed to the first region in the second direction in the stacking direction;

the second region through which the first region communicates with the third region; and a fourth region, disposed at a position different from the second region, through which the first region communicates with the third region.

7. The heat exchanger according to claim 6, further comprising:

a partition portion disposed between the first region and the third region and between the second region and the fourth region.

8. The heat exchanger according to claim 7, wherein the partition portion is integrated with the third plate-shaped portion with a communication portion protruding from a part of the third plate-shaped portion, the part of the third plate-shaped portion corresponds to a contour of any of the first, second, third, and fourth regions.

9. The heat exchanger according to claim 8, wherein the communication portion is shorter in length in the stacking direction than the partition portion.

10. The heat exchanger according to claim 8, wherein the fourth plate-shaped portion includes:

a portion that is in contact with the partition portion; and an opening over the communication portion as seen in the stacking direction.

11. The heat exchanger according to claim 8, further comprising:

a fifth plate-shaped portion disposed between the first plate-shaped portion and the third plate-shaped portion, wherein the fifth plate-shaped portion includes:

a portion that is in contact with the partition portion; and an opening over the communication portion as seen in the stacking direction.

12. The heat exchanger according to claim 1, wherein the refrigerant flow path formation opening in the third plate-shaped portion divides into a plurality of portions as the refrigerant flow path formation opening extends away from the first region in the second direction.

13. A heat pump apparatus comprising:

the heat exchanger according to claim 1; and a fan that generates a flow of air passing through the heat exchanger, wherein the communication openings in the fourth plate-shaped portion are disposed on a windward side with respect to a center of the fourth plate-shaped portion in an air flowing direction, and each of the heat transfer tubes is a flat tube.

14. A heat exchanger connected to a first pipe through which a refrigerant flows, the heat exchanger comprising:

heat transfer tubes; and a header connected to the heat transfer tubes, wherein the header includes:

a first plate-shaped portion connected to the first pipe;

a second plate-shaped portion connected to the heat transfer tubes;

a third plate-shaped portion disposed between the first plate-shaped portion and the second plate-shaped portion; and a fourth plate-shaped portion that is disposed between the third plate-shaped portion and the second plate-shaped portion and that has communication openings for the heat transfer tubes, the first plate-shaped portion, the third plate-shaped portion, the fourth plate-shaped portion, and the second plate-shaped portion are stacked and overlap in a stacking direction, the third plate-shaped portion has a refrigerant flow path formation opening including:

a first region through which the refrigerant flows in a first direction perpendicular to the stacking direction; and a second region through which the refrigerant flows in a second direction that is perpendicular to the stacking direction and that is different from the first direction, the first pipe communicates with the heat transfer tubes via the refrigerant flow path formation opening in the third plate-shaped portion and the communication openings in the fourth plate-shaped portion, the third plate-shaped portion and the fourth plate-shaped portion are stacked in contact with each other, the header has:

refrigerant flow paths on a first side of the refrigerant flow path formation opening in a refrigerant flowing direction; and refrigerant flow paths on a second side of the refrigerant flow path formation opening in the refrigerant flowing direction, and a number of the refrigerant flow paths on the first side are different is 3 times or more than a number of the refrigerant flow paths on the second side.

15. The heat exchanger according to claim 14, wherein the communication openings overlap the first region in the stacking direction.

16. A heat exchanger connected to a first pipe through which a refrigerant flows, the heat exchanger comprising:

heat transfer tubes; and a header connected to the heat transfer tubes, wherein the header includes:

a first plate-shaped portion connected to the first pipe;

a second plate-shaped portion connected to the heat transfer tubes;

a third plate-shaped portion disposed between the first plate-shaped portion and the second plate-shaped portion; and a fourth plate-shaped portion that is disposed between the third plate-shaped portion and the second plate-shaped portion and that has communication openings for the heat transfer tubes, the first plate-shaped portion, the third plate-shaped portion, the fourth plate-shaped portion, and the second plate-shaped portion are stacked and overlap in a stacking direction, the third plate-shaped portion has a refrigerant flow path formation opening including:

a first region through which the refrigerant flows in a first direction perpendicular to the stacking direction; and a second region through which the refrigerant flows in a second direction that is perpendicular to the stacking direction and that is different from the first direction, the first pipe communicates with the heat transfer tubes via the refrigerant flow path formation opening in the third plate-shaped portion and the communication openings in the fourth plate-shaped portion, and the communication openings in the fourth plate-shaped portion are arranged at a position biased to a windward side in a direction perpendicular to both the stacking direction and a direction in which the heat transfer tubes are arranged.

17. A heat exchanger connected to a first pipe through which a refrigerant flows, the heat exchanger comprising:

heat transfer tubes; and a header connected to the heat transfer tubes, wherein the header includes:

a first plate-shaped portion connected to the first pipe;

a second plate-shaped portion connected to the heat transfer tubes;

a third plate-shaped portion disposed between the first plate-shaped portion and the second plate-shaped portion; and a fourth plate-shaped portion that is disposed between the third plate-shaped portion and the second plate-shaped portion and that has communication openings for the heat transfer tubes, the first plate-shaped portion, the third plate-shaped portion, the fourth plate-shaped portion, and the second plate-shaped portion are stacked and overlap in a stacking direction, the third plate-shaped portion has a refrigerant flow path formation opening including:

a first region through which the refrigerant flows in a first direction perpendicular to the stacking direction; and a second region through which the refrigerant flows in a second direction that is perpendicular to the stacking direction and that is different from the first direction, the first pipe communicates with the heat transfer tubes via the refrigerant flow path formation opening in the third plate-shaped portion and the communication openings in the fourth plate-shaped portion, the third plate-shaped portion and the fourth plate-shaped portion are stacked in contact with each other, the communication openings overlap the first region in the stacking direction, the first plate-shaped portion and the fourth plate-shaped portion define a space including:

the first region;

a third region juxtaposed to the first region in the second direction in the stacking direction;

the second region through which the first region communicates with the third region; and a fourth region, disposed at a position different from the second region, through which the first region communicates with the third region, the heat exchanger further comprises a partition portion disposed between the first region and the third region and between the second region and the fourth region, the partition portion is integrated with the third plate-shaped portion with a communication portion protruding from a part of the third plate-shaped portion, the part of the third plate-shaped portion corresponds to a contour of any of the first, second, third, and fourth regions, and the fourth plate-shaped portion includes:

a portion that is in contact with the partition portion; and an opening over the communication portion as seen in the stacking direction.

18. A heat pump apparatus comprising:

a heat exchanger connected to a first pipe through which a refrigerant flows, the heat exchanger comprising:

heat transfer tubes; and a header connected to the heat transfer tubes;

a fan that generates a flow of air passing through the heat exchanger, wherein the header includes:

a first plate-shaped portion connected to the first pipe;

a second plate-shaped portion connected to the heat transfer tubes;

a third plate-shaped portion disposed between the first plate-shaped portion and the second plate-shaped portion; and a fourth plate-shaped portion that is disposed between the third plate-shaped portion and the second plate-shaped portion and that has communication openings for the heat transfer tubes, the first plate-shaped portion, the third plate-shaped portion, the fourth plate-shaped portion, and the second plate-shaped portion are stacked and overlap in a stacking direction, the third plate-shaped portion has a refrigerant flow path formation opening including:

a first region through which the refrigerant flows in a first direction perpendicular to the stacking direction; and a second region through which the refrigerant flows in a second direction that is perpendicular to the stacking direction and that is different from the first direction, the first pipe communicates with the heat transfer tubes via the refrigerant flow path formation opening in the third plate-shaped portion and the communication openings in the fourth plate-shaped portion, the third plate-shaped portion and the fourth plate-shaped portion are stacked in contact with each other, the communication openings overlap the first region in the stacking direction, the communication openings in the fourth plate-shaped portion are disposed on a windward side with respect to a center of the fourth plate-shaped portion in an air flowing direction, and each of the heat transfer tubes is a flat tube.

* * * * *